US008903262B2

(12) United States Patent
Shirafuji et al.

(10) Patent No.: US 8,903,262 B2
(45) Date of Patent: Dec. 2, 2014

(54) IMAGE FORMING APPARATUS RESPONSIVE TO IMAGE FORMING CONDITIONS

(75) Inventors: Yasuhito Shirafuji, Kashiwa (JP); Nobuhiko Zaima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 390 days.

(21) Appl. No.: 13/313,292

(22) Filed: Dec. 7, 2011

(65) Prior Publication Data

US 2012/0163850 A1 Jun. 28, 2012

(30) Foreign Application Priority Data

Dec. 28, 2010 (JP) ..... 2010-293012

(51) Int. Cl.
*G03G 15/00* (2006.01)
*G03G 15/01* (2006.01)

(52) U.S. Cl.
CPC ..... *G03G 15/5058* (2013.01); *G03G 15/0189* (2013.01)
USPC ..... 399/72

(58) Field of Classification Search
USPC ..... 399/72, 49, 156; 382/258; 358/2.1
See application file for complete search history.

(56) References Cited

U.S. PATENT DOCUMENTS 6,067,377 A * 5/2000 Hata ..... 382/167
8,355,175 B2 * 1/2013 Noguchi ..... 358/2.1

FOREIGN PATENT DOCUMENTS

JP 2006-98473 A 4/2006
JP 2007-67932 A 3/2007
JP 2007-199591 A 8/2007
JP 2008250046 A * 10/2008
JP 2009-290612 A 12/2009

* cited by examiner

*Primary Examiner* — Billy Lactaoen
(74) *Attorney, Agent, or Firm* — Canon USA, Inc., IP Division

(57) ABSTRACT

An image forming apparatus includes an image forming unit, a decision unit, an output unit, a control unit, and a setting unit. The image forming unit forms an image on an image bearing member. The decision unit decides a first image forming condition of the image forming unit for forming the image at a width that is wider than a predetermined width. The output unit outputs a signal in accordance with the thickness of the image. The control unit causes the image forming unit to form a measurement image having a width that is narrower than or equal to the predetermined width. The setting unit sets a second image forming condition of the image forming unit so that the thickness of the image that is narrower than or equal to the predetermined width becomes thinner than or equal to the predetermined thickness.

20 Claims, 12 Drawing Sheets

FIG. 11

```
91 { char_color={0.0,0.0,0.0,1.0};
     string1-"IC";
     put_char(0.0,0.0,0.3,0.1,string1);

92 { line_color={1.0,0.0,0.0,0.0};
     put_char(0.9,0.0,00.9,1.0,0.1);

93 { image1={CMYK,8,5,5,C0,M0,Y0,K0,
                        C1,M1,Y1,K1,
                                 :
                        C24,M24,Y24,K24};
     put_image(0.0,0.5,0.5,0.5,image1);
```

IMAGE FORMING APPARATUS RESPONSIVE TO IMAGE FORMING CONDITIONS

BACKGROUND OF THE INVENTION

1. Field of the Invention

The present invention relates to a control for correcting a toner amount of a toner image formed in an image forming apparatus that adopts an electrophotographic system.

2. Description of the Related Art

In a full-color image forming apparatus that adopts an electrophotographic system, electrostatic latent images formed on a photosensitive member are developed by using developer including toner of respective color components to form toner images of the respective color components. These toner images of the respective color components are overlapped and transferred in a transfer unit so that a full-color toner image in accordance with an original is formed. This toner image is fused on a sheet such as paper by applying heat and pressure in a fusing unit and thereafter output from the image forming apparatus as a printed product.

A density of the toner image formed by this image forming apparatus is decided by the amount of toner per unit area in the formed toner image.

However, when toner images of a plurality of color components are overlapped to form a full-color toner image, if the amount of toner in the overlapped and formed toner image (the amount of toner per unit area) exceeds an upper limit amount, the mutual toners charged to a homopolarity repel each other, and scattering of the toner occurs. Furthermore, when the toner image is fused on the sheet, the amount of toner in this overlapped toner image is too large to be fused, the toner scatters by the heat and the pressure applied from the fusing unit.

This scattering of the toner is particularly likely to occur in a part for a line drawing or a character. When the scattering of the toner occurs in the part corresponding to the line drawing, a line drawing thicker than a line width of the original image is formed. If the scattering of the toner occurs in a part corresponding to the character, the character cannot be read, or it becomes difficult to read the character.

According to Japanese Patent Laid-Open No. 2006-98473, the toner amount of the toner image of the line drawing or the character is predicted from a density detected from a toner image for a density detection, and an upper limit value of a signal level at a part for the line drawing or the character is decided from this prediction result. At this time, like the toner image corresponding to the area for the line drawing or the character, the toner amount of the toner image for the density detection at a rear end part in a direction in which the toner image is conveyed is increased since a development field concentrates. For that reason, as the value of the density of the toner image for the density detection at the rear end part in the direction in which the toner image is conveyed is higher than the value of the density at the central part in this conveyance direction, the toner amount in the area for the line drawing or the character is also increased. With this configuration, according to Japanese Patent Laid-Open No. 2006-98473, by correcting the signal level in the area for the line drawing or the character to have a value equal to or smaller than the upper limit value decided from the prediction result, it is possible to suppress the toner amount of the toner image of the line drawing or the character formed in accordance with this corrected signal level.

However, even when the signal level in the area for the line drawing or the character is corrected to have a value equal to or smaller than the upper limit value by using the method described in Japanese Patent Laid-Open No. 2006-98473, a problem exists that the scattering of the toner occurs in the part for the line drawing or the character since an environment is changed or a large number of images are formed.

This is because the toner image bearing the toner at a narrow width smaller than or equal to a predetermined width tends to have a larger toner amount than the rear end part of the toner image bearing the toner in an area wider than the predetermined width due to the degradation of the developer since the temperature or the humidity is changed or a large number of images are formed. For that reason, in a case where the areas of the line drawing and the character are formed, even when the signal levels of these areas are corrected to be smaller than or equal to the upper limit value predicted from the value of the density, the actually formed toner image has the toner amount larger than the amount of the upper limit at which the scattering of the toner can be suppressed.

SUMMARY OF THE INVENTION

In view of the above, the present invention provides an image forming apparatus in which it is possible to more highly accurately suppress scattering of toner in a part for a line drawing or a character irrespective of a change in an environment or a degradation of developer.

According to an aspect of the present invention, an image forming apparatus includes an image forming unit configured to form an image on an image bearing member, a decision unit configured to decide a first image forming condition of the image forming unit for forming the image at a width that is wider than a predetermined width so that a thickness of the image, in a direction orthogonal to a surface of the image bearing member, becomes thinner than or equal to a predetermined thickness, an output unit configured to output a signal in accordance with the thickness of the image, a control unit configured to cause the image forming unit to form a measurement image having a width that is narrower than or equal to the predetermined width, and a setting unit configured to set a second image forming condition of the image forming unit for forming the image at a width that is narrower than or equal to the predetermined width, based on a signal output by the output unit in accordance with the measurement image, so that the thickness of the image that is narrower than or equal to the predetermined width becomes thinner than or equal to the predetermined thickness.

Further features and aspects of the present invention will become apparent from the following description of exemplary embodiments with reference to the attached drawings.

BRIEF DESCRIPTION OF THE DRAWINGS

FIG. 11 illustrates a description example of image data described in a page-description language.

DESCRIPTION OF THE EMBODIMENTS

A first embodiment will be described.

Figure 1:
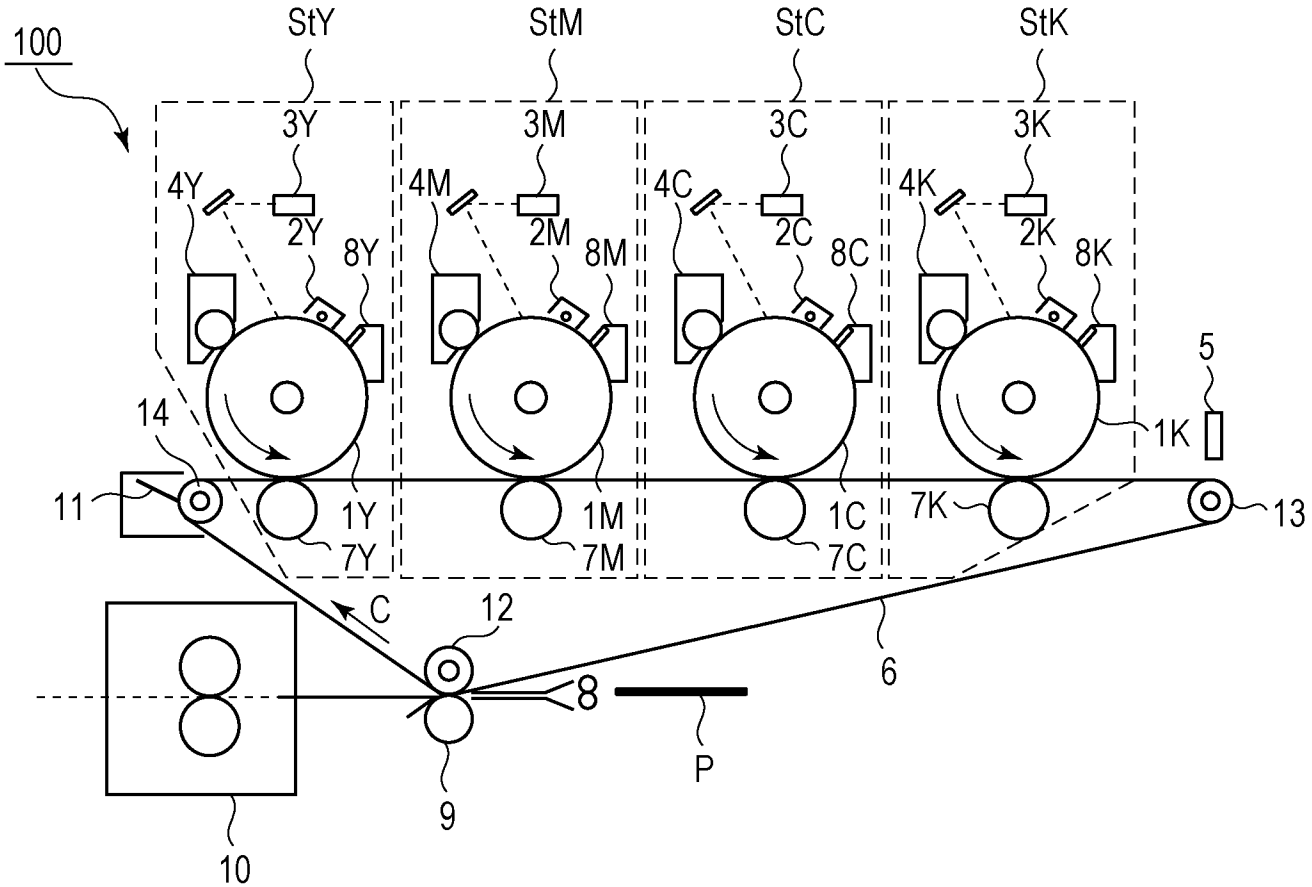
FIG. 1 is a schematic cross sectional view of an image forming apparatus.

FIG. 1 is a schematic cross sectional view of an image forming apparatus 100 according to the present embodiment. According to the present embodiment, an image forming apparatus is used in which four image forming units StY, StM, StC, and StK that form toner images of the respective color components are placed in one line.

With regard to the respective image forming units, the image forming unit StY forms a toner image of yellow, the image forming unit StM forms a toner image of magenta, the image forming unit StC forms a toner image of cyan, and the image forming unit StK forms a toner image of black.

Since the respective image forming units StY, StM, StC, and StK have a similar configuration, hereinafter, the image forming unit StY that forms the toner image of yellow will be described, and the description of the configuration of the other image forming units StM, StC, and StK will be omitted.

The image forming unit StY has a photosensitive drum 1Y that bears a toner image of a color component of yellow, a charging unit 2Y that charges the photosensitive drum 1Y, and an exposure apparatus 3Y that exposes the photosensitive drum 1Y for forming an electrostatic latent image corresponding to the color component of yellow on the photosensitive drum 1Y. Furthermore, the image forming unit StY has a developing unit 4Y that develops the electrostatic latent image formed on the photosensitive drum 1Y as a toner image by using developer having toner and a primary transfer roller 7Y that transfers the toner image on the photosensitive drum 1Y to an intermediate transfer belt 6 which will be described below. Also, the image forming unit StY has a drum cleaner 8Y that removes the residual toner on the photosensitive drum 1Y after the toner image is transferred.

The above-described intermediate transfer belt 6 is an image bearing member on which the toner image is borne, and by overlapping and bearing the toner images of the respective color components formed by the respective image forming units StY, StM, StC, and StK, the full-color toner image is formed. Also, the intermediate transfer belt 6 is suspended around a driving roller 13 that rotates and drives the intermediate transfer belt 6 and a driven roller 14.

Also, a secondary transfer roller 9 for transferring the toner image on the intermediate transfer belt 6 to a sheet P such as paper and a roller 12 are arranged in the vicinity of the intermediate transfer belt 6. Furthermore, a toner height sensor unit 5 which will be described below configured to detect a height of the toner image borne on the intermediate transfer belt 6 and a belt clearer 11 configured to remove the residual toner which is not transferred from the intermediate transfer belt 6 to the sheet P are arranged.

Next, a description will be provided of an image forming operation by the image forming apparatus 100 for outputting an image in accordance with an original image input from a reading apparatus, a PC, or the like which is not illustrated in the drawing.

In the respective image forming units StY, StM, StC, and StK, first, the charging units 2Y, 2M, 2C, and 2K uniformly charge the photosensitive drums 1Y, 1M, 1C, and 1K. Subsequently, when the exposure apparatuses 3Y, 3M, 3C, and 3K irradiate the respective photosensitive drums 1Y, 1M, 1C, and 1K with exposure light in accordance with the image data of the respective color components of the original, electrostatic latent images of the respective color components of this original are formed. After that, the electrostatic latent images on the photosensitive drums 1Y, 1M, 1C, and 1K are developed by the developing units 4Y, 4M, 4C, and 4*k* as the toner images of the respective color components.

The toner images of the respective color components on the photosensitive drums 1Y, 1M, 1C, and 1K are conveyed to a primary transfer nip portion where the primary transfer rollers 7Y, 7M, 7C, and 7K press the photosensitive drums 1Y, 1M, 1C, and 1K via the intermediate transfer belt 6 along with rotations of the photosensitive drums 1Y, 1M, 1C, and 1K. In the primary transfer nip portion, the toner images of the respective color components on the photosensitive drums 1Y, 1M, 1C, and 1K are applied with a primary transfer voltage from the primary transfer rollers 7Y, 7M, 7C, and 7K and sequentially overlapped and transferred onto the intermediate transfer belt 6. According to this, the full-color toner image is formed on the intermediate transfer belt 6. Also, the residual toner on the photosensitive drums 1Y, 1M, 1C, and 1K is removed by the drum cleaners 8Y, 8M, 8C, and 8K.

The toner image transferred to the intermediate transfer belt 6 is conveyed to a secondary transfer nip portion where the secondary transfer roller 9 presses the roller 12 via the intermediate transfer belt 6. On the other hand, when the sheet P is conveyed to the secondary transfer nip portion so as to contact the full-color toner image after a timing is adjusted, the full-color toner image on the intermediate transfer belt 6 is transferred onto the sheet P by the secondary transfer roller 9 applied with a secondary transfer voltage. Also, the residual toner on the intermediate transfer belt 6 which is not transferred to the sheet P in the secondary transfer nip portion is removed by the belt clearer 11.

The sheet P bearing the toner image is conveyed to the fusing unit 10, and this toner image is fused by the heat and the pressure.

Also, in the image forming apparatus 100, when the exposure apparatuses 3Y, 3M, 3C, and 3K expose the photosensitive drums 1Y, 1M, 1C, and 1K, electrostatic latent images corresponding to toner images for measuring the density (hereinafter, which will be referred to as patch image) are formed. When the electrostatic latent images are developed by the developing units 4Y, 4M, 4C, and 4K, the developed patch images are transferred by the primary transfer rollers 7Y, 7M, 7C, and 7K to the intermediate transfer belt 6. The patch image formed on the intermediate transfer belt 6 is subjected to the detection of the toner height equivalent to the density by the above-described toner height sensor unit 5. To elaborate, this is because the density of the toner image is decided by a toner adhesion amount, and when the toner adhesion amount is increased, this can be detected as a toner height. It is noted that the toner height is a thickness of the patch image in a direction orthogonal to the surface of the intermediate transfer belt 6.

Next, by using FIGS. 2A and 2B, FIGS. 3A and 3B, and FIG. 4, a description will be provided of a method of detecting the toner height of the patch image formed on the intermediate transfer belt 6 by the toner height sensor unit 5 of FIG. 1.

Figure 2A:
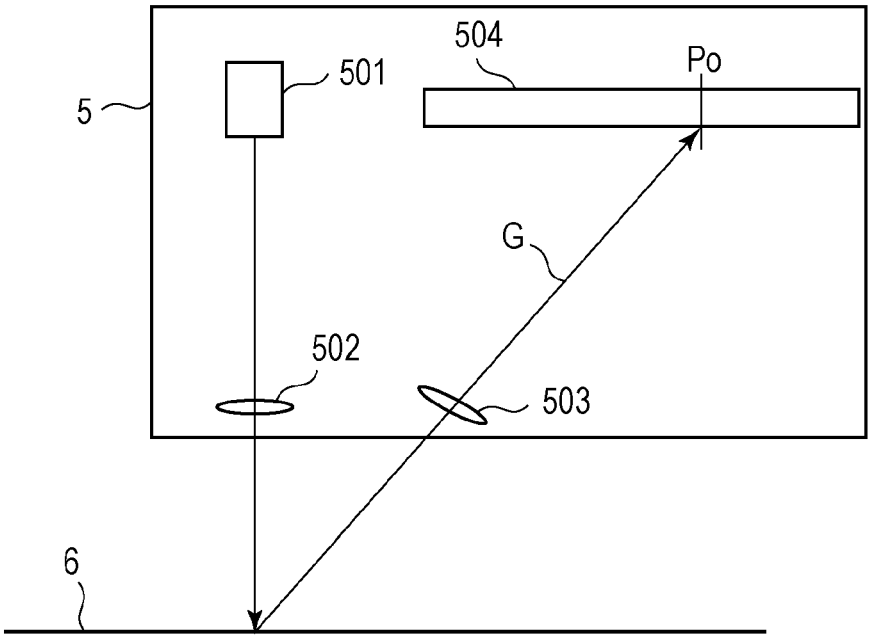
FIGS. 2A and 2B are main-part schematic diagrams of a toner height sensor unit.
Figure 2B:
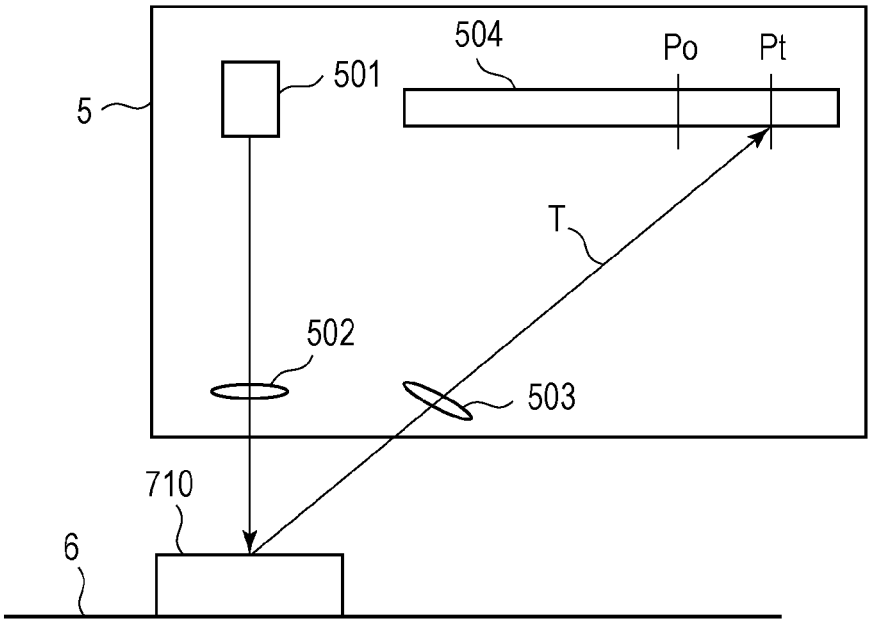

FIG. 2A and FIG. 2B are main-part schematic diagrams of the toner height sensor unit 5 illustrated in FIG. 1. The intermediate transfer belt 6 is moved from a proximal end to a distal end while facing the drawing.

The toner height sensor unit 5 is composed of a laser oscillator 501 as an irradiation section, a collective lens 502, a light receiving lens 503, and a line sensor 504 as a light reception section.

The laser oscillator 501 irradiates the measurement light (wavelength 850 [nm]) via the collective lens 502 so as to have a spot diameter of 50 [μm] on the intermediate transfer belt 6.

The line sensor 504 has a configuration provided with a light reception surface where a large number of light reception elements are placed in one line. Also, the respective light reception elements of the line sensor 504 have a configuration of outputting a voltage in accordance with a light intensity when the light is received. Also, a configuration may be adopted in which a pitch of the light reception elements is set as one piece of toner having an average particle size, and even in a case where the toner height of the patch image is changed, a change in a light reception position can be detected.

FIG. 2A illustrates a state at a time before a patch image 710 reaches an irradiation position where the light is irradiated from the laser oscillator 501. The measurement light irradiated from the laser oscillator 501 is reflected by the intermediate transfer belt 6 and received by the line sensor 504.

FIG. 2B illustrates a state in which the intermediate transfer belt 6 is moved from the proximal end to the distal end while facing the drawing and the patch image 710 is conveyed to the irradiation position. The state is illustrated in which the measurement light irradiated from the laser oscillator 501 is reflected by the patch image 710 and received by the line sensor 504.

Next, a description will be provided of a method for the toner height sensor unit 5 to receive the reflection light from the intermediate transfer belt 6 and the reflection light from the patch image 710.

First, like FIG. 2A, when the measurement light is irradiated from the laser oscillator 501, the measurement light is irradiated from the laser oscillator 501 via the collective lens 502 onto the intermediate transfer belt 6. This measurement light is reflected by the surface of the intermediate transfer belt 6 and imaged at a light reception position Po on the line sensor 504 via the light receiving lens 503 like reflection light G. Herein, the reflection light G represents a barycentric position of the like passing through the center of the light receiving lens 503 within the reflection light from the intermediate transfer belt 6. Also, the reflection light that is not incident to the light receiving lens 503 has a configuration of being shielded by a shielding plate which is not illustrated in the drawing.

Next, in a state in which the measurement light is irradiated, when the intermediate transfer belt 6 is moved from the proximal end to the distal end while facing the drawing, like FIG. 2B, the patch image 710 borne on the intermediate transfer belt 6 reaches the irradiation position. At this time, the measurement light irradiated from the laser oscillator 501 is reflected by the patch image 710 and imaged at a light reception position Pt on the line sensor 504 via the light receiving lens 503 like reflection light T. Herein, the reflection light T represents a barycentric position of the like passing through the center of the light receiving lens 503 within the reflection light the patch image 710. Also, the reflection light that is not incident to the light receiving lens 503 has a configuration of being shielded by the shielding plate which is not illustrated in the drawing.

Next, a description will be provided of a method of obtaining a light reception position difference ΔPt between the light reception position Po of the reflection light from the intermediate transfer belt 6 and the light reception position Pt of the reflection light from the patch image 710.

Figure 3A:
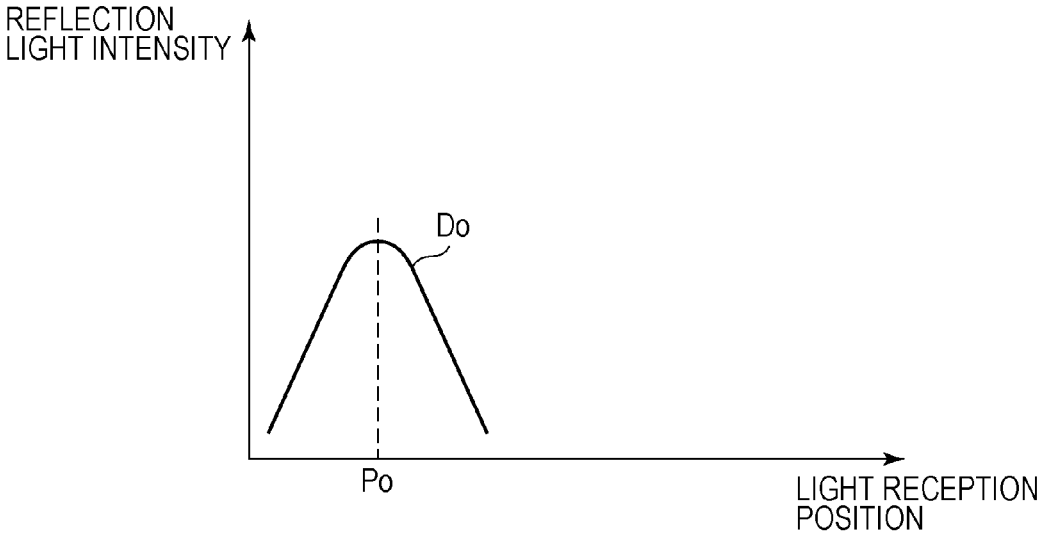
FIGS. 3A and 3B illustrate an operation of detecting a light reception position from a light intensity of a patch image measured by the toner height sensor unit.

FIG. 3A illustrates a distribution (intensity distribution) of a light intensity Do of the light reflected by the surface of the intermediate transfer belt 6 which is measured by the line sensor 504 of FIG. 2A. The light reception position Po of the reflection light from the intermediate transfer belt 6 becomes a position on the light reception surface where the light intensity Do of this reflection light becomes a highest value.

Figure 3B:
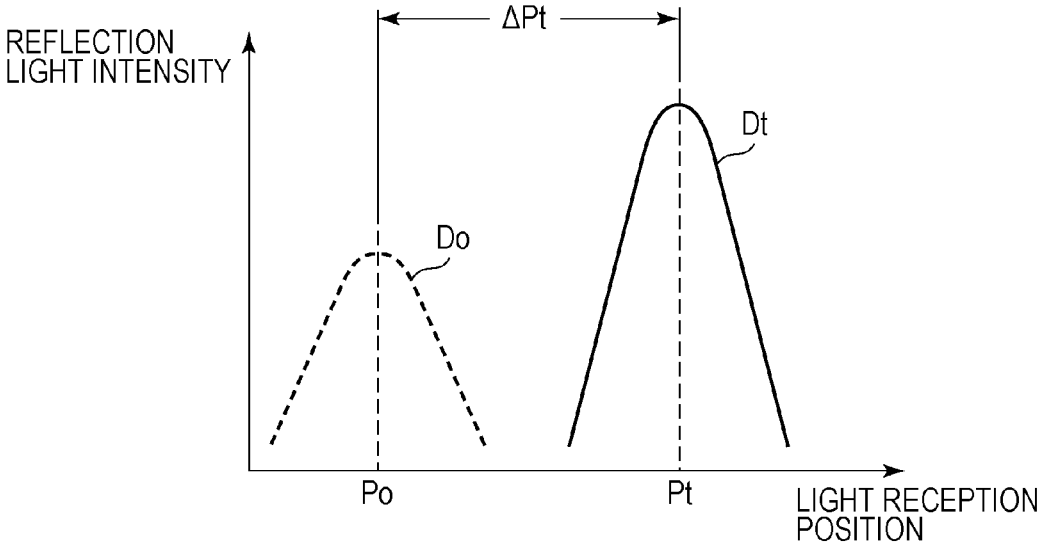

FIG. 3B illustrates a distribution (intensity distribution) of a light intensity Dt of the light reflected by the surface of the patch image 710 which is measured by the line sensor 504 of FIG. 2B. The light reception position Pt of the reflection light from the patch image 710 becomes a position on the light reception surface where the light intensity Dt of this reflection light becomes a highest value. It is noted that in FIG. 3B, the distribution of the distribution of the light intensity Do of the light reflected by the surface of the intermediate transfer belt 6 of FIG. 2A is illustrated by a broken line.

From FIG. 3B, the light reception position Po of the reflection light from the intermediate transfer belt 6 and the light reception position Pt of the reflection light from the patch image 710 are different from each other by the toner height of the patch image 710. For that reason, according to the present embodiment, a CPU 800 (FIG. 7) detects each of the light reception position Po of the reflection light from the intermediate transfer belt 6 and the light reception position Pt of the reflection light from the patch image 710 by the toner height sensor unit 5. Subsequently, the CPU 800 (FIG. 7) identifies a toner height Ht of the patch image 710 from the difference between the light reception position Po and the light reception position Pt (the light reception position difference ΔPt) which is detected by the toner height sensor unit 5.

Figure 4:
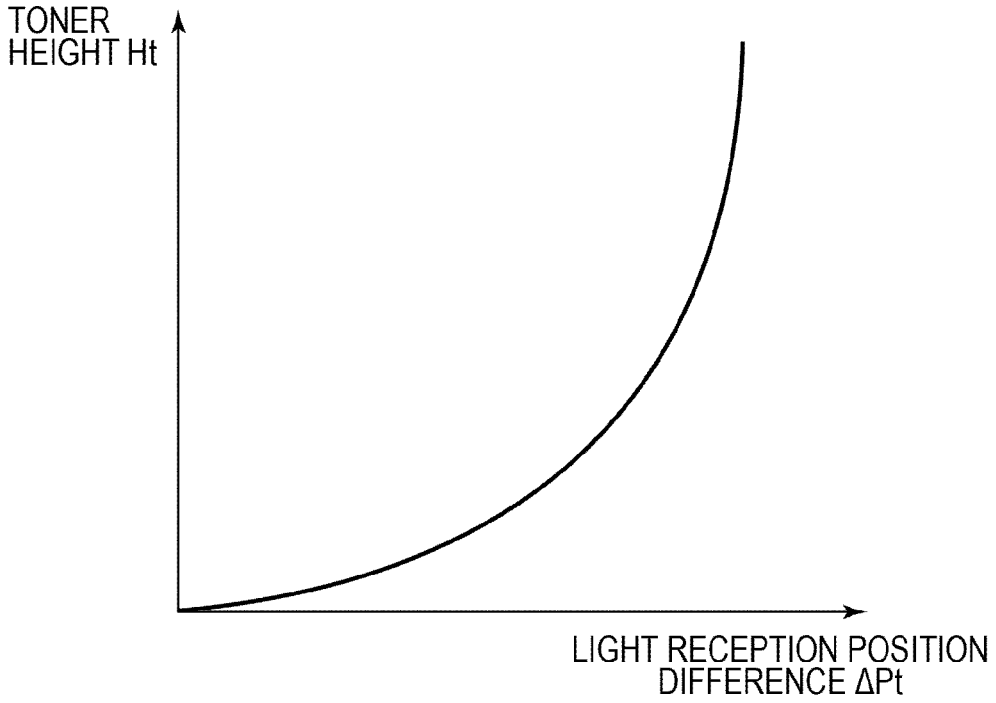
FIG. 4 illustrates a correspondence relationship between a light reception position difference and a toner height.
Figure 7:
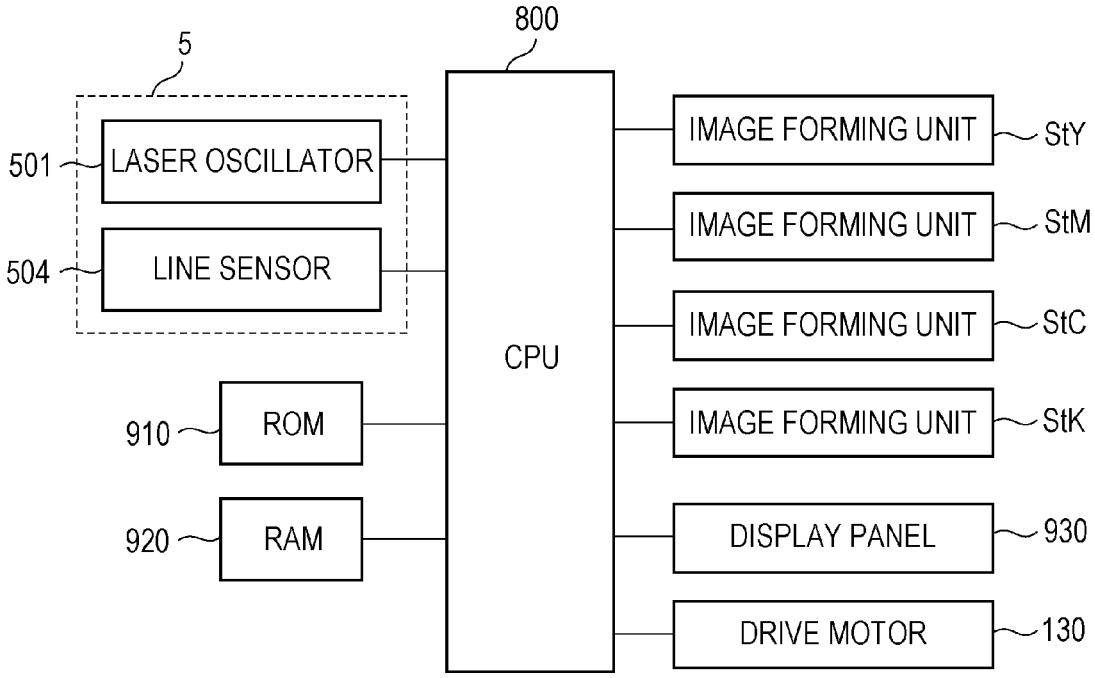
FIG. 7 is a control block diagram of an image forming apparatus according to a first embodiment.

FIG. 4 illustrates data indicating a correspondence relation between the light reception position difference ΔPt and the toner height. From the difference (the light reception position difference ΔPt) between the light reception position Pt of the reflection light from the patch image 710 and the light reception position Po of the reflection light from the intermediate transfer belt 6, by referring to the data indicating the correspondence relation between the light reception position difference ΔPt and the toner height of FIG. 4, the toner height Ht of the patch image 710 is obtained. It is noted that the data indicating the correspondence relation between the light reception position difference ΔPt and the toner height is previously stored in a ROM 910 which will be described below (FIG. 7).

By adjusting the image forming condition in a manner that the thus obtained toner height Ht becomes a toner height corresponding to a target value of an arbitrary density, the CPU (FIG. 7) can decide the image forming condition at a time when the toner image at the arbitrary density is formed.

Also, according to the present embodiment, the line sensor 504 is used as a configuration of detecting the light reception position for the reflection light from the intermediate transfer belt 6 and the light reception position for the reflection light from the patch image 710, but a configuration may be adopted in which an area sensor has a light reception surface where the light reception elements are placed in a two-dimensional manner.

According to the present embodiment, the image forming condition at a time when the scattering of the toner does not occur is decided on the basis of the toner height of the toner image thicker than a predetermined width, and the image forming condition for preventing the occurrence of the scattering of the toner is decided on the basis of the toner height of the toner image having a width smaller than or equal to the predetermined width. It is noted that the predetermined width according to the present embodiment refers to a width of 1 [mm]. Also, the image forming condition includes a charge voltage, a development bias, a transfer voltage, an exposure light amount, an exposure time, and the like. As a method of controlling only the toner height in the area having a width smaller than or equal to the predetermined width in the area for one sheet, it is simple to control the exposure light amount and the exposure time instead of controlling the charge voltage, the development bias, and the transfer voltage. Herein, a method of controlling the exposure time and the exposure light amount includes a processing of correcting a signal level input to the exposure apparatuses 3Y, 3M, 3C, and 3K of FIG. 1.

This processing of correcting the signal level is a processing of correcting, in a case where the total of the signal levels when the toner images of the respective color components are overlapped and formed is larger than an upper limit value of the signal level generated by the scattering of the toner, the total of the signal levels of the respective color components to be smaller than or equal to the upper limit. According to this, it is possible to control the toner height when the toner image corresponding to the image data is formed to be smaller than or equal to a target height at which the scattering of the toner is suppressed. It is noted that the signal levels are equivalent to gradations in the respective pixels when the toner image corresponding to the image data is formed and are parameters for changing the amount of toner per unit area in the toner image (hereinafter, which will be referred to as toner deposition amount).

According to an experiment, in a case where the toner image having the toner height higher than 35 [μm] obtained by overlapping the toner images of the respective color components is fused, the scattering of the toner occurs. Also, the toner height when the toner image of one color is formed at the maximum signal level becomes 14 [μm]. To elaborate, it is understood that the scattering of the toner occurs when the toner image at the highest density is overlapped by more than 2.5 colors worth.

According to the present embodiment, the signal level is represented in 100 stages from 1 to 100, the signal level when the toner image of one color is formed by one of the image forming units StY, StM, StC, and StK at the maximum density is 100. To elaborate, the signal level when the toner images at the highest density are overlapped by four colors worth becomes 400.

According to the present embodiment, the signal levels of the respective color components are corrected by using Expression 1 to Expression 4 so that the total of the signal levels in a state in which the toner images of the respective color components are overlapped becomes smaller than or equal to 250. In Expression 1 to Expression 4, so that the total of the signal levels of the respective color components becomes smaller than or equal to the upper limit value, the signal level for each color component is multiplied by a ratio of the total of the signal levels of the respective color components to the upper limit value.

$$Y1 = \frac{Tr}{Y0 + M0 + C0 + K0} * Y0, \quad \text{(where } Y0 + M0 + C0 + K0 \geq 250\text{)} \qquad \text{(Expression 1)}$$

$$M1 = \frac{Tr}{Y0 + M0 + C0 + K0} * M0, \quad \text{(where } Y0 + M0 + C0 + K0 \geq 250\text{)} \qquad \text{(Expression 2)}$$

$$C1 = \frac{Tr}{Y0 + M0 + C0 + K0} * C0, \quad \text{(where } Y0 + M0 + C0 + K0 \geq 250\text{)} \qquad \text{(Expression 3)}$$

$$K1 = \frac{Tr}{Y0 + M0 + C0 + K0} * K0, \quad \text{(where } Y0 + M0 + C0 + K0 \geq 250\text{)} \qquad \text{(Expression 4)}$$

In Expression 1 to Expression 4, Tr denotes an upper limit value of the signal level for overlapping and forming the toner images of the respective color components of yellow, magenta, cyan, and black. In Expression 1 to Expression 4, in a case where the toner height in a state in which a plurality of toner images are overlapped is suppressed to 2.5 colors worth, Tr becomes 250.

Also, in Expression 1 to Expression 4, Y0 denotes a signal level when the toner image of yellow before the correction is formed, M0 denotes a signal level of magenta before the correction, C0 denotes a signal level of cyan before the correction, and K0 denotes a signal level of black before the correction.

Furthermore, in Expression 1, Y1 denotes a signal level of the toner image of yellow after the correction and is calculated by multiplying a value, which is obtained by dividing the upper limit value Tr by the total value of the signal levels of the respective color components before the correction, by the signal level of yellow before the correction.

Similarly, in Expression 2, M1 denotes a signal level of the toner image of magenta after the correction and is calculated by multiplying a value, which is obtained by dividing the upper limit value Tr by the total value of the signal levels of the respective color components before the correction, by the signal level of magenta before the correction.

Also, in Expression 3, C1 denotes a signal level of the toner image of cyan after the correction and is calculated by multiplying a value, which is obtained by dividing the upper limit value Tr by the total value of the signal levels of the respective color components before the correction, by the signal level of cyan before the correction.

Also, in Expression 4, K1 denotes a signal level of the toner image of black after the correction and is calculated by multiplying a value, which is obtained by dividing the upper limit value Tr by the total value of the signal levels of the respective color components before the correction, by the signal level of black before the correction.

Herein, a description will be provided of a case as an example in which a fine-line toner image is formed where the signal levels are yellow 90, magenta 80, cyan 70, and black 30 (the total of the signal levels is 270) and a line width is 0.3 [mm]. When the upper limit value of the signal level of this toner image is 250, the upper limit value Tr of the signal level becomes 250. By using Expression 1 to Expression 4, the signal levels of the respective color components are corrected in a manner that the signal level of yellow becomes 83, the signal level of magenta becomes 74, the signal level of cyan becomes 65, and the signal level of black becomes 28.

It is noted that according to the present embodiment, in a case where the total of the signal levels of the respective color components is smaller than or equal to 250, the signal levels are not corrected.

However, even when the signal levels of the respective color components are corrected in a manner that the total becomes smaller than or equal to the upper limit value, the scattering of the toner may occur in some cases in the toner image of the character or the line drawing. In view of the above, according to the present embodiment, in a case where the toner image bearing the toner at a width smaller than or equal to 1 [mm] is formed, in order to control the toner deposition amount of this toner image to an amount at which the scattering of the toner is suppressed, the upper limit value of the signal level is changed.

Figure 5:
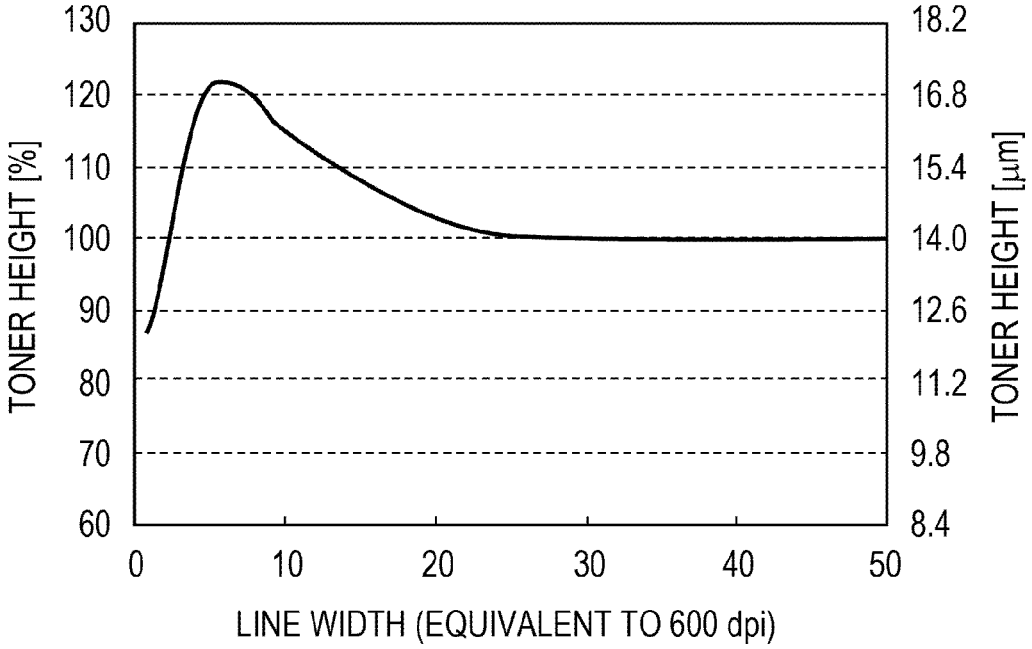
FIG. 5 illustrates a correspondence relationship between a width of a toner image and the toner height.

FIG. 5 illustrates results of the toner heights detected from a plurality of toner images having mutually different lengths in a movement direction of the intermediate transfer belt 6 (conveyance direction). These toner images are formed in a manner that a straight-line toner image having a length of 600 pixels worth in a direction orthogonal to the movement direction of the intermediate transfer belt 6 is changed by one pixel each from one pixel to 50 pixels in this movement direction by the image forming apparatus having a recording resolution of 600 [dpi]. It is noted that one pixel becomes approximately 42.3 [μm] in the image forming apparatus having the recording resolution of 600 [dpi].

From FIG. 5, it is understood that the toner height is increased by approximately 20 [%] as compared with the solid toner image in the fine-line toner image in a range between 3 pixels (approximately 0.13 [mm]) and 8 pixels (approximately 0.34 [mm]). Also, the toner height of this toner image is changed depending on the temperature, the humidity, and the charge amount of the toner.

In view of the above, according to the present embodiment, in accordance with the toner heights detected from the patch images of the respective color components, when a plurality of toner images are overlapped and formed, the upper limit value of the total of the signal levels is changed.

To be more specific, the solid patch image is formed for each color component, and the image forming condition is controlled so that toner heights Ht1*y*, Ht1*m*, Ht1*c*, and Ht1*k* of these solid patch images become the toner heights equivalent to the maximum density. It is noted that Ht1*y* denotes a toner height of the solid patch image of yellow, Ht1*m* denotes a toner height of the solid patch image of magenta, Ht1*c* denotes a toner height of the solid patch image of cyan, and Ht1*k* denotes a toner height of the solid patch image of black.

Subsequently, the fine-line patch image is formed for each color component in the image forming condition where the toner heights Ht1*y*, Ht1*m*, Ht1*c*, and Ht1*k* of the solid patch images become the toner heights corresponding to the maximum density, and toner heights Ht2*y*, Ht2*m*, Ht2*c*, and Ht2*k* of the fine-line patch images of the respective color components are obtained. It is noted that Ht2*y* denotes a toner height of the fine-line patch image of yellow, Ht2*m* denotes a toner height of the fine-line patch image of magenta, Ht2*c* denotes a toner height of the fine-line patch image of cyan, and Ht2*k* denotes a toner height of the fine-line patch image of black.

Subsequently, from Expression 5 to Expression 8, proportions of the toner heights Ht2*y*, Ht2*m*, Ht2*c*, and Ht2*k* of the fine-line patch images while the toner heights Ht1*y*, Ht1*m*, Ht1*c*, and Ht1*k* of the solid patch images are used as the reference are calculated.

$$Ry=Ht2y/Ht1y \quad \text{(Expression 5)}$$

$$Rm=Ht2m/Ht1m \quad \text{(Expression 6)}$$

$$Rc=Ht2c/Ht1c \quad \text{(Expression 7)}$$

$$Rk=Ht2k/Ht1k \quad \text{(Expression 8)}$$

It is noted that in Expression 5, Ry denotes a toner height ratio of yellow and is a ratio of the toner height Ht2*y* of the fine-line patch image of yellow with respect to the toner height Ht1*y* of the solid patch image of yellow. Also, in Expression 6, Rm denotes a toner height ratio of magenta and is a ratio of the toner height Ht2*m* of the fine-line patch image of magenta with respect to the toner height Ht1*m* of the solid patch image of magenta. In Expression 7, Rc denotes a toner height ratio of cyan and is a ratio of the toner height Ht2*c* of the fine-line patch image of cyan with respect to the toner height Ht1*c* of the solid patch image of cyan. In Expression 8, Rk denotes a toner height ratio of black and is a ratio of the toner height Ht2*k* of the fine-line patch image of black with respect to the toner height Ht1*k* of the solid patch image of black. Also, according to an experiment, the toner height ratios Ry, Rm, Rc, and Rk of the respective color components change in a range between 1 and 2.5.

As represented by Expression 9, an average value of the toner height ratio Ry of yellow, the toner height ratio Rm of magenta, the toner height ratio Rc of cyan, and the toner height ratio Rk of black is obtained. In the following description, this average value of the toner height ratios is used for identifying the upper limit value Tr of the signal level when the toner images of the respective color components are overlapped and formed. Hereinafter, the above-described average value is referred to as average toner height ratio Rave.

$$Rave=(Ry+Rm+Rc+Rk)/4 \quad \text{(Expression 9)}$$

It is noted that the scattering of the toner occurs in a state in which the toner images of the respective color components of yellow, magenta, cyan, and black are overlapped. For that reason, according to the present embodiment, the upper limit value Tr of the signal level is obtained from the average value Rave of the toner height ratios Ry, Rm, Rc, and Rk of the respective color components.

Table 1 is data indicating a correspondence relationship between the upper limit value Tr of the signal level in a fine-line area for preventing the occurrence of the scattering of the toner which is decided from the experience by the inventors of the present application et al. and the average toner height ratio Rave.

Herein, the fine-line area is an area of a character or a line drawing which bears the toner at a width smaller than or equal to a predetermined width. It is noted that according to the present embodiment, for the character determined as the fine-line area, a character size is set to be smaller than or equal to 32 points, and for the line drawing determined as the fine-line area, a line is set to have a line thickness smaller than or equal to 1 [mm].

Also, according to the present embodiment, the upper limit value Tr of the signal level in an area where the toner is borne at a width wider than 1 [mm] is set as 250. A reason why the upper limit value Tr of the signal level in the area where the toner is borne at the width wider than 1 [mm] is set as 250 is that the toner height of the toner image at the width wider than 1 [mm] does not become high enough to cause the scattering of the toner by the environment change or the degradation of the developer too.

According to the present embodiment, while following the data in Table 1, the upper limit value Tr of the signal level in the fine-line area in accordance with the average toner height ratio Rave is set.

For example, in a case where the toner height ratio Rave is larger than 1.0 and smaller than or equal to 1.2, the upper limit value Tr of the signal level in the fine-line area is set as 240, and in a case where the toner height ratio Rave is larger than 1.2 and smaller than or equal to 1.4, the upper limit value Tr of the signal level in the fine-line area is set as 230.

TABLE 1

| Average toner height ratio Rave | Upper limit value Tr of the signal level in the fine-line area |
|---|---|
| 1.0 | 250 |
| 1.2 | 240 |
| 1.4 | 230 |
| 1.6 | 220 |
| 1.8 | 210 |
| 2 | 200 |

Figure 6:
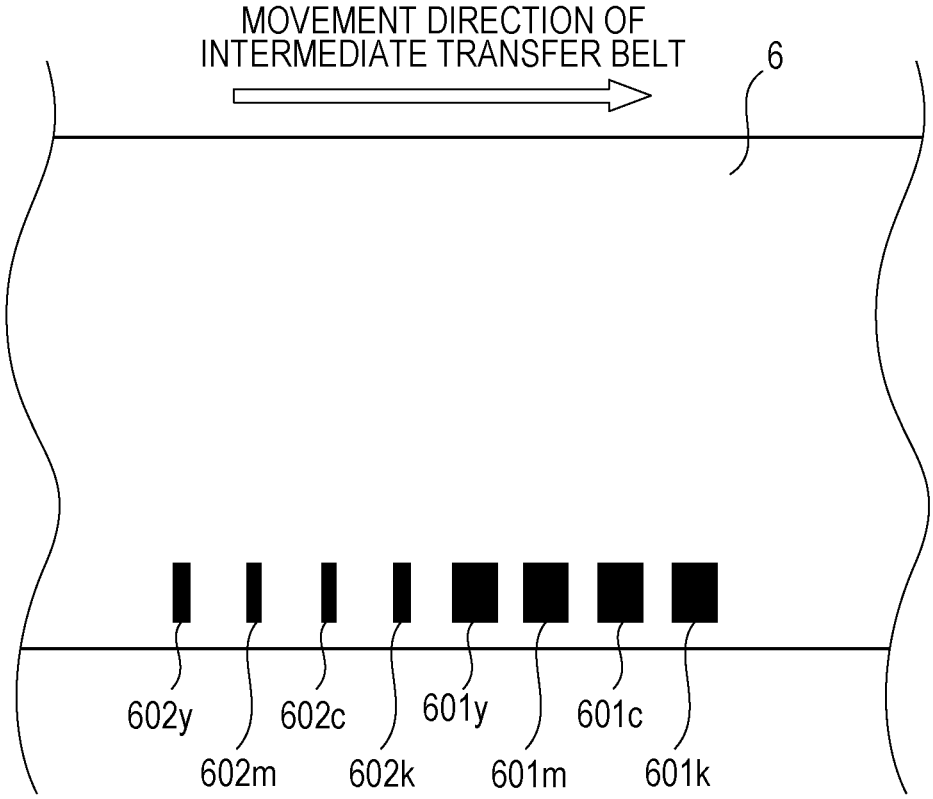
FIG. 6 is a schematic diagram of a solid patch image and a fine-line patch image borne on an intermediate transfer belt.

Next, by using FIG. 6, a description will be provided of the solid patch images and the fine-line patch images formed by the image forming apparatus according to the present embodiment in a case where the average toner height ratio Rave is obtained.

FIG. 6 illustrates solid patch images 601*y*, 601*m*, 601*c*, and 601*k* and fine-line patch images 602*y*, 602*m*, 602*c*, and 602*k* formed on the intermediate transfer belt 6 as the image bearing member. It is noted that the solid patch images 601*y*, 601*m*, 601*c*, and 601*k* are equivalent to first toner images, and the fine-line patch images 602*y*, 602*m*, 602*c*, and 602*k* are equivalent to second toner images.

The solid patch images 601*y*, 601*m*, 601*c*, and 601*k* are formed in which the length in the movement direction of the intermediate transfer belt 6 is 5 [mm] and the length in the direction orthogonal to this movement direction is 10 [mm]. It is noted that the solid patch images 601*y*, 601*m*, 601*c*, and 601*k* borne on the intermediate transfer belt 6 are patch images in which both the length in the movement direction of the intermediate transfer belt 6 and the length in the direction orthogonal to the movement direction of the intermediate transfer belt 6 are longer than 1 [mm].

Also, the fine-line patch images 602*y*, 602*m*, 602*c*, and 602*k* are formed in which the length in the movement direction of the intermediate transfer belt 6 is 0.25 [mm] and the length in the direction orthogonal to this movement direction is 10 [mm]. It is noted that the width in the movement direction of the intermediate transfer belt 6 of the fine-line patch images 602*y*, 602*m*, 602*c*, and 602*k* (0.25 [mm]) is equal to a width of 6 pixels worth in the image forming apparatus having the recording resolution of 600 [dpi].

Also, according to the present embodiment, a width in a shorter-side direction of the fine-line patch images 602*y*, 602*m*, 602*c*, and 602*k* is a width of 6 pixels worth. However, this width of the fine-line patch images 602*y*, 602*m*, 602*c*, and 602*k* is not limited to this dimension.

The width of the fine-line patch images 602*y*, 602*m*, 602*c*, and 602*k* may be any width as long as the width is smaller than or equal to 1 [mm] at which the scattering of the toner easily occurs. It is however noted that in this case, it is necessary to set the correspondence relationship between the upper limit value Tr and the average toner height ratio Rave so that the fine-line toner image at the width of 6 pixels worth which is formed through the correction for setting the total of the signal levels of the respective color components to be smaller than or equal to the upper limit value Tr, has the toner height at which the scattering of the toner does not occur. It is noted that a reason why the fine-line toner image at the width of 6 pixels worth is set as the reference is that the experiment result demonstrates that in a case where the fine-line toner image is formed by changing the width in the same image forming condition, the fine-line toner image at the width of 6 pixels worth has the highest toner height, and the scattering of the toner easily occurs.

Also, preferably, the solid patch images 601*y*, 601*m*, 601*c*, and 601*k* and the fine-line patch images 602*y*, 602*m*, 602*c*, and 602*k* are formed at the maximum density. Regarding the toner image borne on the intermediate transfer belt 6, as the density is higher, in other words, as the signal level is higher, the smoothness is more improved. For that reason, the patch image is formed in which the signal level is 100 can more accurately identify the above-described light reception position as compared with the patch image that is formed in which the signal level is smaller than 100. According to this, it is possible to accurately calculate the average toner height ratio Rave from the toner heights Ht1*y*, Ht1*m*, Ht1*c*, and Ht1*k* of the solid patch images and the toner heights Ht2*y*, Ht2*m*, Ht2*c*, and Ht2*k* of the fine-line patch images.

Figure 8:
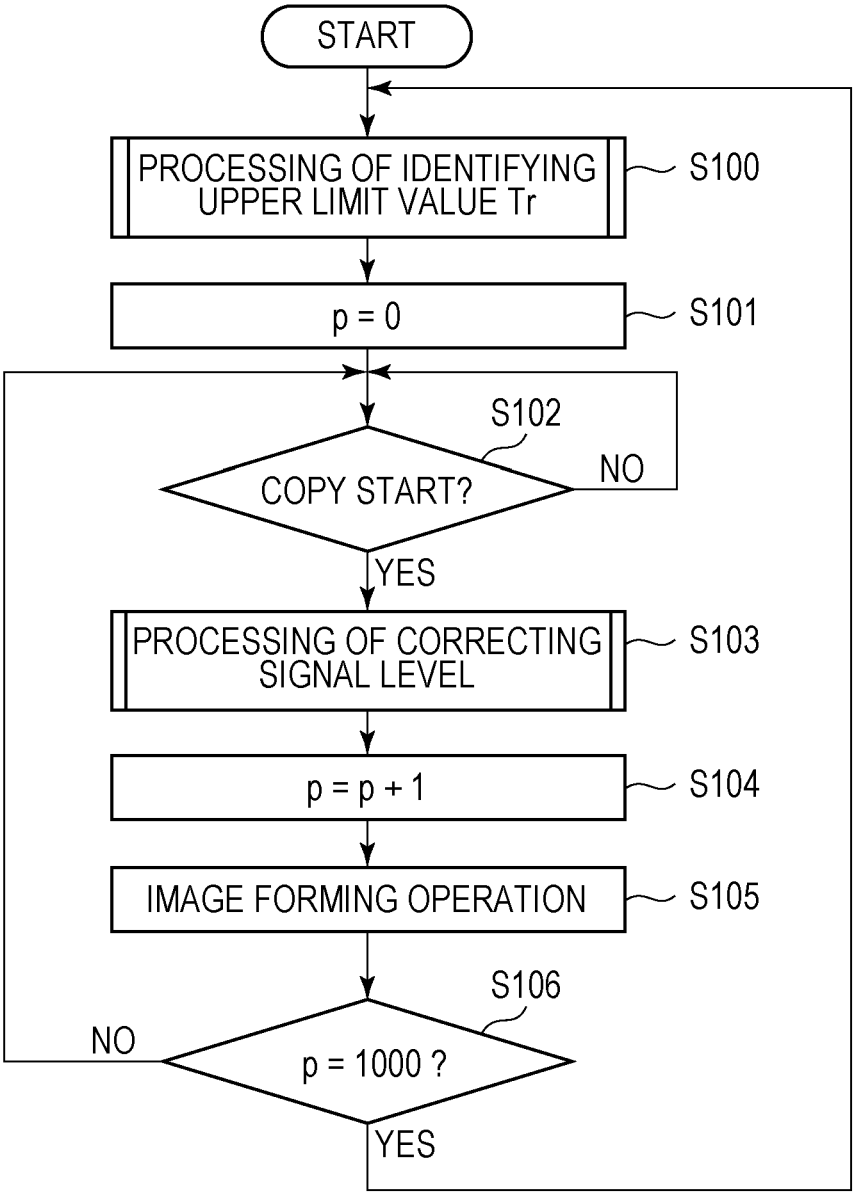
FIG. 8 is a flow chart representing a processing of forming an image by the image forming apparatus according to the first embodiment.

FIG. 7 is a control block diagram of the image forming apparatus according to the present embodiment. Also, FIG. 8 is a flow chart for describing an operation of the CPU when the image forming apparatus according to the present embodiment forms an image.

In FIG. 7, the CPU 800 is a control circuit that controls the entirety of the image forming apparatus. The ROM 910 stores a control program for controlling various processings executed by the image forming apparatus. Also, the ROM 910 is a storage unit and previously stores the data (Table 1) indicating the correspondence relationship between the above-described measured average toner height ratio Rave and the upper limit value Tr of the signal level in the fine-line area at the time of factory shipment. Also, the RAM 920 is a system work memory used by the CPU 800 for the processing.

The laser oscillator 501 irradiates the measurement light onto the intermediate transfer belt 6 in accordance with the signal from the CPU 800. By receiving the reflection light from the intermediate transfer belt 6 or the reflection light from the patch image, the line sensor 504 outputs currents in accordance with the light intensities from the light reception elements. It is noted that the CPU 800 detects the position of the light reception element that outputs the largest current value as the light reception position of the reflection light on the basis of the values of the currents in accordance with the light intensities output from the light reception elements of the line sensor 504.

The image forming unit StY is composed of the photosensitive drum 1Y, the charging unit 2Y, the exposure apparatus 3Y, the developing unit 4Y, and the primary transfer roller 7Y of FIG. 1. In response to the instruction from the CPU 800, by using the image forming condition stored in the ROM 910 or the RAM 920, the image forming unit StY forms the solid patch image 601*y* of yellow and the fine-line patch image 602*y* of yellow described above on the intermediate transfer belt 6. It is noted that the photosensitive drum 1Y, the charging unit 2Y, the exposure apparatus 3Y, the developing unit 4Y, and the primary transfer roller 7Y are similar to FIG. 1, and therefore the description of the configuration will be omitted.

The image forming unit StM is composed of the photosensitive drum 1M, the charging unit 2M, the exposure apparatus 3M, the developing unit 4M, and the primary transfer roller 7M of FIG. 1. In response to the instruction from the CPU 800, by using the image forming condition stored in the ROM 910 or the RAM 920, the image forming unit StM forms the solid patch image 601*m* of magenta and the fine-line patch image 602*m* of magenta described above on the intermediate transfer belt 6. It is noted that the photosensitive drum 1M, the charging unit 2M, the exposure apparatus 3M, the developing unit 4M, and the primary transfer roller 7M are similar to FIG. 1, and therefore the description of the configuration will be omitted.

The image forming unit StC is composed of the photosensitive drum 1C, the charging unit 2C, the exposure apparatus 3C, the developing unit 4C, and the primary transfer roller 7C of FIG. 1. In response to the instruction from the CPU 800, by using the image forming condition stored in the ROM 910 or the RAM 920, the image forming unit StC forms the solid patch image 601*c* of cyan and the fine-line patch image 602*c* of cyan described above on the intermediate transfer belt 6. It is noted that the photosensitive drum 1C, the charging unit 2C, the exposure apparatus 3C, the developing unit 4C, and the primary transfer roller 7C are similar to FIG. 1, and therefore the description of the configuration will be omitted.

The image forming unit StK is composed of the photosensitive drum 1K, the charging unit 2K, the exposure apparatus 3K, the developing unit 4K, and the primary transfer roller 7K of FIG. 1. Also, in response to the instruction from the CPU 800, by using the image forming condition stored in the ROM 910 or the RAM 920, the image forming unit StK forms the solid patch image 601*k* of black and the fine-line patch image 602*k* of black described above on the intermediate transfer belt 6. It is noted that the photosensitive drum 1K, the charging unit 2K, the exposure apparatus 3K, the developing unit 4K, and the primary transfer roller 7K are similar to FIG. 1, and therefore the description of the configuration will be omitted.

Herein, the above-described image forming condition includes the charge voltage of the charging units 2Y, 2M, 2C, and 2K, the exposure light amount and the exposure time of the exposure apparatuses 3Y, 3M, 3C, and 3K, the development bias of the developing units 4Y, 4M, 4C, and 4K, the transfer voltage applied to the primary transfer rollers 7Y, 7M, 7C, and 7K, and the like.

A display panel 930 has a liquid crystal screen for reporting an abnormity of the image forming apparatus. A configuration is adopted in which a content of the abnormity is displayed while a signal for reporting the abnormity is input from the CPU 800.

A drive motor 130 is a stepping motor and rotates the driving roller 13 of FIG. 1 when being applied with the current in accordance with the signal from the CPU 800. Since the driving roller 13 rotates, the intermediate transfer belt 6 of FIG. 1 is driven in an arrow C direction.

Hereinafter, the image forming processing for the image forming apparatus according to the present embodiment to form the image will be described in detail by using a flow chart represented in FIG. 8.

It is noted that the processing in the flow chart of FIG. 8 will be executed by reading out the program stored in the ROM 910 by the CPU 800.

First, the CPU 800 performs a processing of identifying the upper limit value Tr when a main power supply of the image forming apparatus is turned on (S100), and after the upper limit value Tr of the signal level at a time when the toner images of the respective color components are overlapped, a sheet number count value p is reset to 0 (S101). It is noted that the processing of identifying the upper limit value Tr in step S100 will be described by using FIG. 9, and therefore the detailed description thereof will be omitted.

Subsequently, the CPU 800 stands by until a signal for starting a copy is input (S102), and when image data is input from an external apparatus such as a PC, a processing of correcting the signal level which will be described below is performed (S103). The processing of correcting the signal level in step S103 will be described below by using FIG. 13, and therefore the detailed description thereof will be omitted.

Subsequently, the CPU 800 increments the sheet number count value p by 1 (S104), and the image forming operation is performed by the image forming units StY, StM, StC, and StK (S105). In step S104, each time the image formation for one sheet is carried out, the sheet number count value p is incremented by 1. Also, in step S105, the CPU 800 forms the toner image based on the signal level corrected in step S103 by the image forming units StY, StM, StC, and StK. The toner images of the respective color components are overlapped on the intermediate transfer belt 6 (FIG. 1) to be formed. In step S105, the image forming units StY, StM, StC, and StK function as image forming units that form the overlapped toner image obtained by overlapping the toner images of the plurality of color components.

Subsequently, the CPU 800 determines whether or not the sheet number count value p is larger than or equal to 1000 (S106). To elaborate, it is determined whether or not the sheet number of images formed after the upper limit value Tr is identified in step S100 reaches 1000 sheets. Herein, according to the present embodiment, a target value of the sheet number count value p is 1000. However, this target value may be any value as long as the value is a target value of the image forming sheet number at which the fine-line toner height becomes high by the degradation of the developer, and a configuration may also be adopted that the user can set the target value.

In step S106, in a case where the sheet number count value p is smaller than 1000, the flow shifts to step S102.

On the other hand, in step S106, in a case where the sheet number count value p is larger than or equal to 1000, the flow shifts to step S100, and the processing of identifying the upper limit value Tr is carried out again.

According to the present embodiment, since the processing from step S100 to step S106 is repeatedly carried out, and the upper limit value Tr of the signal level at a time when the toner images of the respective color components are overlapped is updated each time when the image forming sheet number becomes 1000 sheets.

Next, a description will be given of the processing of identifying the upper limit value Tr of the signal level at a time when the toner images of the respective color components are overlapped which is executed in step S100 of FIG. 8.

Figure 9:
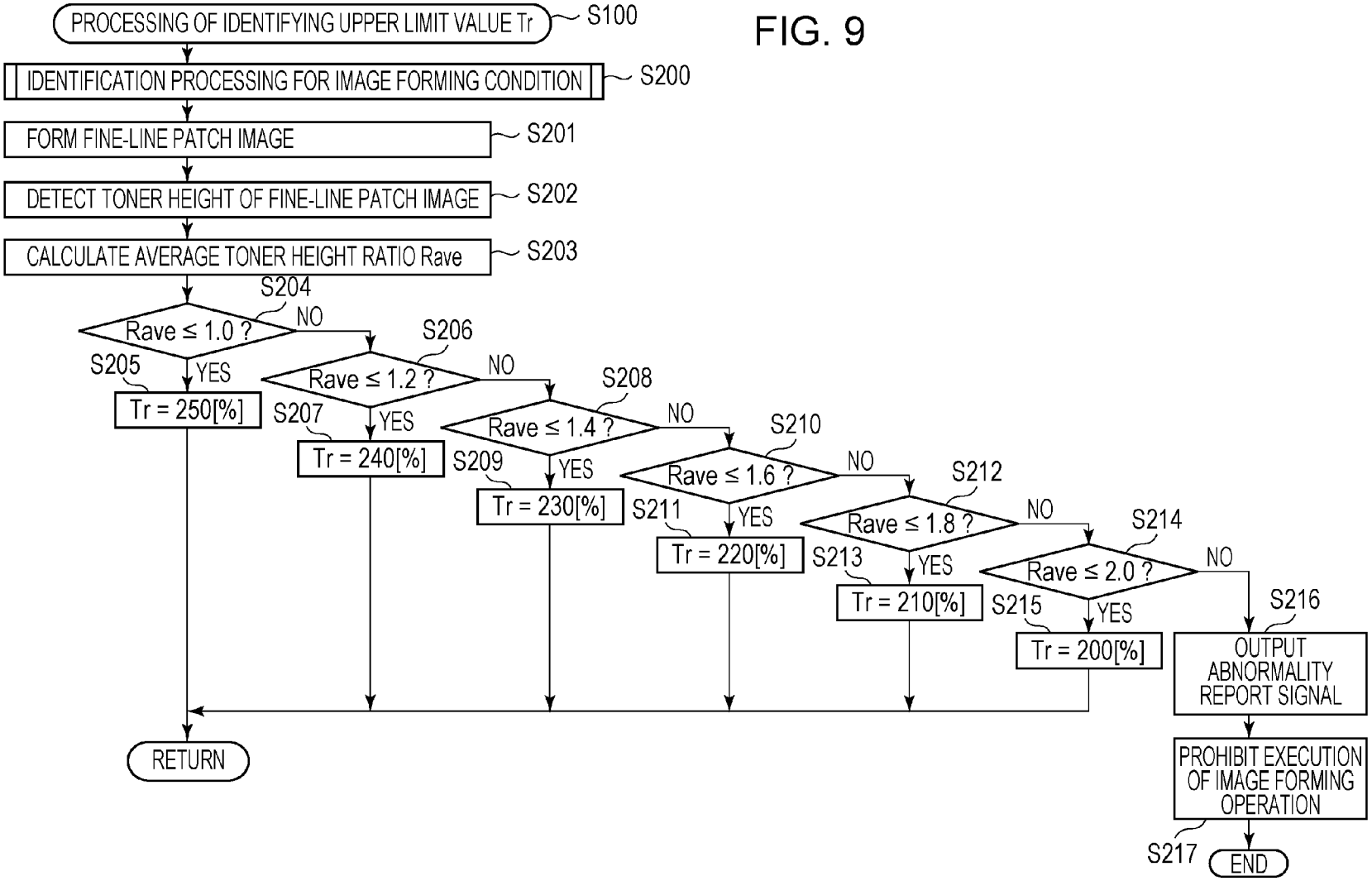
FIG. 9 is a flow chart representing a processing of identifying an upper limit value of a signal level according to the first embodiment.

FIG. 9 is a flow chart illustrating a sub routine for identifying the upper limit value Tr of the signal level at a time when the toner images of the respective color components are overlapped. It is noted that the processing in this flow chart is executed while the CPU 800 reads out the program stored in the ROM 910.

First, the CPU 800 performs the identification processing for the image forming condition and identifies the image forming condition for each color component under which the toner heights of the solid patch images 601*y*, 601*m*, 601*c*, and 601*k* become the target heights (S200). This identified image forming condition is stored in the RAM 920 while being associated with the respective color components. It is noted that the processing of identifying the image forming condition at a time when the toner heights Ht1*y*, Ht1*m*, Ht1*c*, and Ht1*k* of the solid patch images 601*y*, 601*m*, 601*c*, and 601*k* become the target heights in step S200 will be described below by using FIG. 10, and therefore the detailed description thereof will be omitted.

Subsequently, by using the image forming condition stored in the RAM 920 in step S200, the CPU 800 causes the image forming units StY, StM, StC, and StK to form the fine-line patch images of the respective color components 602*y*, 602*m*,

602*c*, 602*k* (S201). In step S201, the fine-line patch images of the respective color components 602*y*, 602*m*, 602*c*, 602*k* are formed at the same signal level as the solid patch images 601*y*, 601*m*, 601*c*, and 601*k*. It is noted that according to the present embodiment, the signal level at a time when the toner heights of the solid patch images 601*y*, 601*m*, 601*c*, and 601*k* becomes a predetermined height is set as 100 (the maximum density), and the fine-line patch images 602*y*, 602*m*, 602*c*, and 602*k* are formed at this signal level.

Subsequently, the CPU 800 irradiates the light from the laser oscillator 501 and detects the toner heights Ht2*y*, Ht2*m*, Ht2*c*, and Ht2*k* of the fine-line patch images 602*y*, 602*m*, 602*c*, and 602*k* from the output current from the line sensor 504 (S202).

At this time, the CPU 800 irradiates the light from the laser oscillator 501 and identifies the position of the light reception element where the current value output from the line sensor 504 becomes the largest as the light reception position at a timing when the respective fine-line patch images 602*y*, 602*m*, 602*c*, and 602*k* reach the irradiation position. Also, the CPU 800 irradiates the light from the laser oscillator 501 and identifies the position of the light reception element where the current value output from the line sensor 504 becomes the largest as the light reception position at a timing when the intermediate transfer belt 6 is located at the irradiation position.

On the basis of the thus identified light reception positions of the lights reflected from the respective fine-line patch images 602*y*, 602*m*, 602*c*, and 602*k* and the light reception position of the light reflected by the intermediate transfer belt 6, the toner heights Ht2*y*, Ht2*m*, Ht2*c*, and Ht2*k* are obtained by using the above-described method.

The current values in accordance with the light intensities output from the light reception elements of the line sensor 504 in step S202 are second signals in accordance with the toner heights Ht2*y*, Ht2*m*, Ht2*c*, and Ht2*k* of the fine-line patch images 602*y*, 602*m*, 602*c*, and 602*k*. Also, in step S202, the laser oscillator 501 functions as a second irradiation section that irradiates the fine-line patch images 602*y*, 602*m*, 602*c*, and 602*k* with light. Also, in step S202, the line sensor 504 functions as a second light reception section having a second light reception surface where the lights reflected from the fine-line patch images 602*y*, 602*m*, 602*c*, and 602*k* are received. To elaborate, in order to identify the light reception position on the second light reception surface, the line sensor 504 outputs the current value in accordance with the light intensity of the received light. According to this, in step S202, the toner height sensor unit 5 functions as a second detection unit that detects the toner heights Ht2*y*, Ht2*m*, Ht2*c*, and Ht2*k* of the fine-line patch images.

Subsequently, the CPU 800 calculates the average toner height ratio Rave from the toner heights Ht1*y*, Ht1*m*, Ht1*c*, and Ht1*k* of the solid images of the respective color components detected in step S202 and the toner heights Ht2*y*, Ht2*m*, Ht2*c*, and Ht2*k* of the fine-line images (S203). It is noted that the average toner height ratio Rave is obtained by calculating the toner height ratios Ry, Rm, Rc, and Rk of the respective colors from Expression 5 to Expression 8 described above and averaging out the toner height ratios Ry, Rm, Rc, and Rk by Expression 9 described above.

Herein, the toner heights Ht1*y*, Ht1*m*, Ht1*c*, and Ht1*k* of the solid patch images 601*y*, 601*m*, 601*c*, and 601*k* become the target heights of the solid patch images 601*y*, 601*m*, 601*c*, and 601*k* formed at the maximum density. It is noted that a reason why the toner heights Ht1*y*, Ht1*m*, Ht1*c*, and Ht1*k* of the solid patch images 601*y*, 601*m*, 601*c*, and 601*k* become the target heights which will be described below in FIG. 10.

Subsequently, the CPU 800 determines whether or not the average toner height ratio Rave obtained in step S203 is smaller than or equal to 1.0 (S204). In step S204, when the average toner height ratio Rave is smaller than or equal to 1.0, the CPU 800 sets the upper limit value Tr of the signal level at a time when the toner images of the respective color components are overlapped as 250 (S205) and stores this value in the RAM 920.

On the other hand, in step S204, in a case where it is determined that the average toner height ratio Rave is larger than 1.0, the CPU 800 determines whether or not the average toner height ratio Rave is smaller than or equal to 1.2 (S206). In step S206, when the average toner height ratio Rave is smaller than or equal to 1.2, the CPU 800 sets the upper limit value Tr of the signal level at a time when the toner images of the respective color components are overlapped as 240 (S207) and stores this value in the RAM 920.

On the other hand, in step S206, in a case where it is determined that the average toner height ratio Rave is larger than 1.2, the CPU 800 determines whether or not the average toner height ratio Rave is smaller than or equal to 1.4 (S208). In step S208, when the average toner height ratio Rave is smaller than or equal to 1.4, the CPU 800 sets the upper limit value Tr of the signal level at a time when the toner images of the respective color components are overlapped as 230 (S209) and stores this value in the RAM 920.

On the other hand, in step S208, in a case where it is determined that the average toner height ratio Rave is larger than 1.4, the CPU 800 determines whether or not the average toner height ratio Rave is smaller than or equal to 1.6 (S210). In step S210, when the average toner height ratio Rave is smaller than or equal to 1.6, the CPU 800 sets the upper limit value Tr of the signal level at a time when the toner images of the respective color components are overlapped as 220 (S211) and stores this value in the RAM 920.

On the other hand, in step S210, in a case where it is determined that the average toner height ratio Rave is larger than 1.6, the CPU 800 determines whether or not the average toner height ratio Rave is smaller than or equal to 1.8 (S212). In step S212, when the average toner height ratio Rave is smaller than or equal to 1.8, the CPU 800 sets the upper limit value Tr of the signal level at a time when the toner images of the respective color components are overlapped as 210 (S213) and stores this value in the RAM 920.

On the other hand, in step S212, in a case where it is determined that the average toner height ratio Rave is larger than 1.8, the CPU 800 determines whether or not the average toner height ratio Rave is smaller than or equal to 2.0 (S214). In step S214, when the average toner height ratio Rave is smaller than or equal to 2.0, the CPU 800 sets the upper limit value Tr of the signal level at a time when the toner images of the respective color components are overlapped as 200 (S215) and stores this value in the RAM 920.

Herein, in a case where the average toner height ratio Rave is larger than 2.0, the toner heights of the fine-line patch images 602*y*, 602*m*, 602*c*, and 602*k* become higher than twofold of the height as compared with the solid patch images 601*y*, 601*m*, 601*c*, and 601*k*.

For that reason, in step S214, in a case where the average toner height ratio Rave is larger than 2.0, the CPU 800 outputs a signal for reporting that the toner height of the fine-line patch image becomes too high to the display panel 930 (S216). By this signal, the display panel 930 performs the display for reporting that the toner heights Ht2*y*, Ht2*m*, Ht2*c*, and Ht2*k* of the fine-line patch images 602*y*, 602*m*, 602*c*, and 602*k* becomes too high.

Subsequently, the CPU 800 prohibits the execution of the image forming operation by the image forming units StY, StM, StC, and StK (S217) and ends the processing of identifying the upper limit value Tr and the image forming processing of FIG. 8. This is because if the upper limit value of the signal level is set as a value smaller than 200, the density of the formed toner image has a density lower than the acceptable density.

Next, the processing of identifying the image forming condition executed in step S200 of FIG. 9 will be described.

According to the present embodiment, the solid patch images 601*y*, 601*m*, 601*c*, 601*k* of the respective color components are formed, and the toner heights Ht1*y*, Ht1*m*, Ht1*c*, and Ht1*k* are detected by the above-described toner height sensor unit 5. Subsequently, the image forming condition for the image forming units StY, StM, StC, and StK at a time when the toner heights Ht1*y*, Ht1*m*, Ht1*c*, and Ht1*k* become the target heights are identified. This identified image forming condition is used as the image forming condition at a time when the fine-line patch images 602*y*, 602*m*, 602*c*, and 602*k* are formed in FIG. 9 described above.

Herein, the target height is a toner height obtained when a toner image is formed in which a density measured by color reflection spectrodensitometer 504 of X-Rite, Incorporated becomes 1.6 (equivalent to the maximum density) and this toner image is detected by the toner height sensor unit 5, and the target height is previously stored in the ROM 910.

Figure 10:
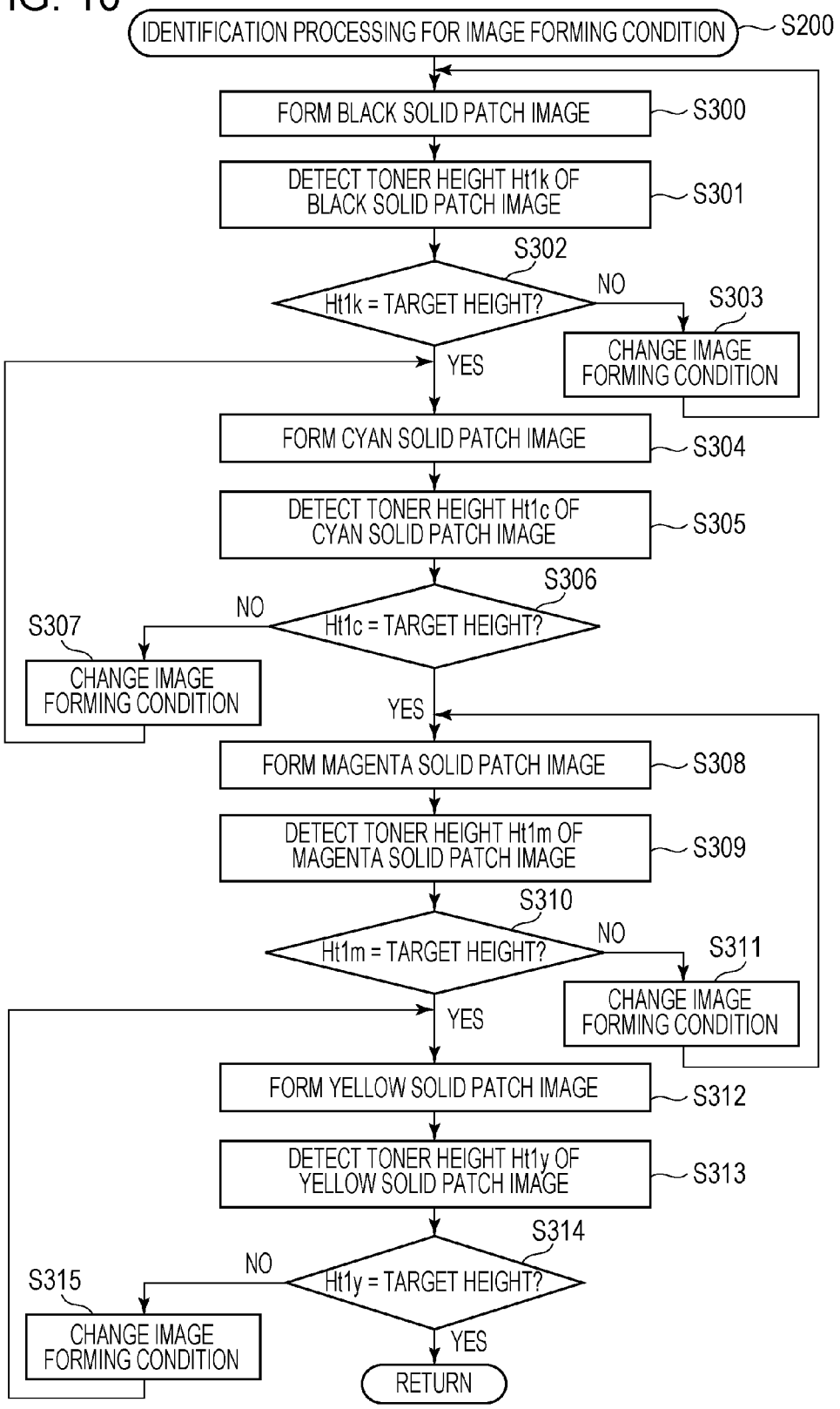
FIG. 10 is a flow chart representing a processing of identifying an image forming condition at a time when the fine-line patch image according to the first embodiment is formed.

Hereinafter, a method of identifying the image forming conditions when the fine-line patch images 602*y*, 602*m*, 602*c*, and 602*k* are formed will be described by using a flow chart of FIG. 10 which illustrates a sub routine for identifying the image forming conditions for the respective color components. It is noted that the processing in this flow chart is executed while the CPU 800 reads out the program stored in the ROM 910.

First, the CPU 800 forms the solid patch image 601*k* of black on the intermediate transfer belt 6 by the image forming unit StK by using the image forming condition stored in the ROM 910 (S300).

Subsequently, the CPU 800 detects the toner height Ht1*k* from the solid patch image 601*k* of black formed on the intermediate transfer belt 6 by the laser oscillator 501 and the line sensor 504 (S301).

Subsequently, the CPU 800 determines whether or not the toner height Ht1*k* detected in step S301 is the target height of the solid patch image 601*k* of black previously stored in the ROM 910 (S302). According to the present embodiment, the target height of the solid patch image 601*k* of black is 14 [μm].

In step S302, if the toner height Ht1*k* does not become the target height, the CPU 800 changes the image forming condition for the image forming unit StK (S303), and the flow shifts to step S300. It is noted that in step S300, the CPU 800 forms the solid patch image 601*k* of black again by the image forming unit StK by using the image forming condition for the image forming unit StK which is changed in step S303.

By repeating step S300 to step S303, until the toner height Ht1*k* becomes the target height, the CPU 800 continues to form the solid patch image 601*k* of black while changing the image forming condition.

On the other hand, in step S302, when the toner height Ht1*k* becomes the target height, the CPU 800 stores the image forming condition at a time when the toner height Ht1*k* becomes the target height as the image forming condition at a time when the fine-line patch image 602*k* of black is formed in the RAM 920. According to this, the image forming condition at a time when the toner height Ht1*k* becomes the target height is identified as the image forming condition at a time when the fine-line patch image 602*k* of black is formed.

In step S302, the current values in accordance with the light intensities output from the respective light reception elements of the line sensor 504 when the toner height Ht1*k* becomes the target height are first signals in accordance with the toner height Ht1*k* of the solid patch image 601*k* of black.

Subsequently, after the image forming condition at a time when the fine-line patch image 602*k* of black is formed is identified, the CPU 800 starts the processing of identifying the image forming condition at a time when the fine-line patch image 602*c* of cyan is formed.

The CPU 800 forms the solid patch image 601*c* of cyan on the intermediate transfer belt 6 by the image forming unit StC by using the image forming condition stored in the ROM 910 (S304).

Subsequently, the CPU 800 detects the toner height Ht1*c* from the solid patch image 601*c* of cyan formed on the intermediate transfer belt 6 by the laser oscillator 501 and the line sensor 504 (S305).

Subsequently, the CPU 800 determines whether or not the toner height Ht1*c* detected in step S305 is the target height of the solid patch image 601*c* of cyan previously stored in the ROM 910 (S306). According to the present embodiment, the target height of the solid patch image 601*c* of cyan is 14 [μm].

In step S306, if the toner height Ht1*c* does not become the target height, the CPU 800 changes the image forming condition for the image forming unit StC (S307), and the flow shifts to step S304. It is noted that in step S304, the CPU 800 forms the solid patch image 601*c* of cyan again by the image forming unit StC by using the image forming condition for the image forming unit StC changed in step S307.

By repeating step S304 to step S307, the CPU 800 continues to form the solid patch image 601*c* of cyan while changing the image forming condition until the toner height Ht1*c* becomes the target height.

On the other hand, in step S306, when the toner height Ht1*c* becomes the target height, the CPU 800 stores the image forming condition at a time when the toner height Ht1*c* becomes the target height in the RAM 920 as the image forming condition at a time when the fine-line patch image 602*c* of cyan is formed. According to this, the image forming condition at a time when the toner height Ht1*c* becomes the target height is identified as the image forming condition at a time when the fine-line patch image 602*c* of cyan is formed.

In step S306, the current values in accordance with the light intensities output from the respective light reception elements of the line sensor 504 when the toner height Ht1*c* becomes the target height are first signals in accordance with the toner height Ht1*c* of the solid patch image 601*c* of cyan.

Subsequently, after the image forming condition at a time when the fine-line patch image 602*c* of cyan is formed, the CPU 800 starts the processing of identifying the image forming condition at a time when the fine-line patch image 602*m* of magenta is formed.

Hereinafter, in step S308 to step S311, the CPU 800 continues to form the solid patch image 601*m* of magenta by the image forming unit StM until the toner height Ht1*m* becomes the target height while changing the image forming condition. It is noted that since the processing from step S308 to step S311 is similar to the processing of identifying the image forming condition at a time when the fine-line patch image 602*k* of black described above is formed and the processing of identifying the image forming condition at a time when the fine-line patch image 602*c* of cyan described above is formed, the detailed description thereof will be omitted.

Also, in step S310, the current values in accordance with the light intensities output from the respective light reception elements of the line sensor 504 when the toner height Ht1*m* becomes the target height are first signals in accordance with the toner height Ht1*m* of the solid patch image 601*m* of magenta.

Subsequently, after the image forming condition after at a time when the fine-line patch image 602*m* of magenta is formed is identified, the CPU 800 starts the processing of identifying the image forming condition at a time when the fine-line patch image 602*y* of yellow is formed.

Hereinafter, in step S312 to step S315, the CPU 800 continues to form the solid patch image 601*y* of yellow while changing the image forming condition until the toner height Ht1*y* becomes the target height by the image forming unit StY. It is noted that since the processing from step S312 to step S315 is similar to the processing of identifying the image forming condition at a time when the fine-line patch image 602*k* of black described above is formed and the processing of identifying the image forming condition at a time when the fine-line patch image 602*c* of cyan described above is formed, the detailed description thereof will be omitted.

Also, in step S314, the current values in accordance with the light intensities output from the respective light reception elements of the line sensor 504 when the toner height Ht1*y* becomes the target height are first signals in accordance with the toner height Ht1*y* of the solid patch image 601*y* of yellow.

When the image forming condition at a time when the fine-line patch images of the respective color components 602*y*, 602*m*, 602*c*, and 602*k* are formed is identified, the CPU 800 ends the identification processing for the image forming condition, and the flow shifts to step S201 where the processing of identifying the upper limit value Tr (FIG. 9) described above is performed. It is noted that in step S301, step S305, step S309, and step S313, the laser oscillator 501 functions as a first irradiation section that irradiates the solid patch images 601*y*, 601*m*, 601*c*, and 601*k* with light. Also, in step S301, step S305, step S309, and step S313, the line sensor 504 functions as a first light reception section that has a first light reception surface where the lights reflected from the solid patch images 601*y*, 601*m*, 601*c*, and 601*k* are received. To elaborate, in order to identify the light reception position on the first light reception surface, the line sensor 504 outputs the current value in accordance with the light intensity of the received light. According to this, in step S301, step S305, step S309, and step S313, the toner height sensor unit 5 functions as a first detection unit that detects the toner heights Ht1*y*, Ht1*m*, Ht1*c*, and Ht1*k* of the solid patch images.

Next, the processing of correcting the signal level executed in step S103 of FIG. 8 will be described.

The CPU 800 (FIG. 7) according to the present embodiment renders the image data to the bitmap data, and the signal levels of the respective color components are corrected in a manner that the total of the signal levels of the respective color components for forming the character, the line drawing, and the photographic image becomes equal to or smaller than the upper limit value Tr identified in the processing of identifying the upper limit value Tr (FIG. 9).

FIG. 11 illustrates an example of image data described in a page-description language. The image data described in the page-description language is generally classified into (a) text data, (b) graphics data, and (c) raster image data.

Image data 91 is a command describing text data to be converted into a character when rendered to the bitmap data. The text data 91 specifies a content of the character, a character color and a signal level (density) thereof, a position arranged on the sheet P, a character size, and a character spacing.

Image data 92 is a command describing graphics data to be converted into a line drawing when rendered to the bitmap data. The graphics data 92 specifies a line color and a signal level (density) thereof, coordinates of a starting point and an end point of the line, and a line thickness.

Image data 93 is a command describing raster image data to be converted into a photographic image when rendered to the bitmap data. The raster image data 93 specifies the number of color components of the photographic image, signal levels (density) of respective dots, a position for a layout for the photographic image, and the like.

In this manner, the image data described in the page-description language can be distinguished into the character, the line drawing, and the photographic image by the commands.

Figure 12:
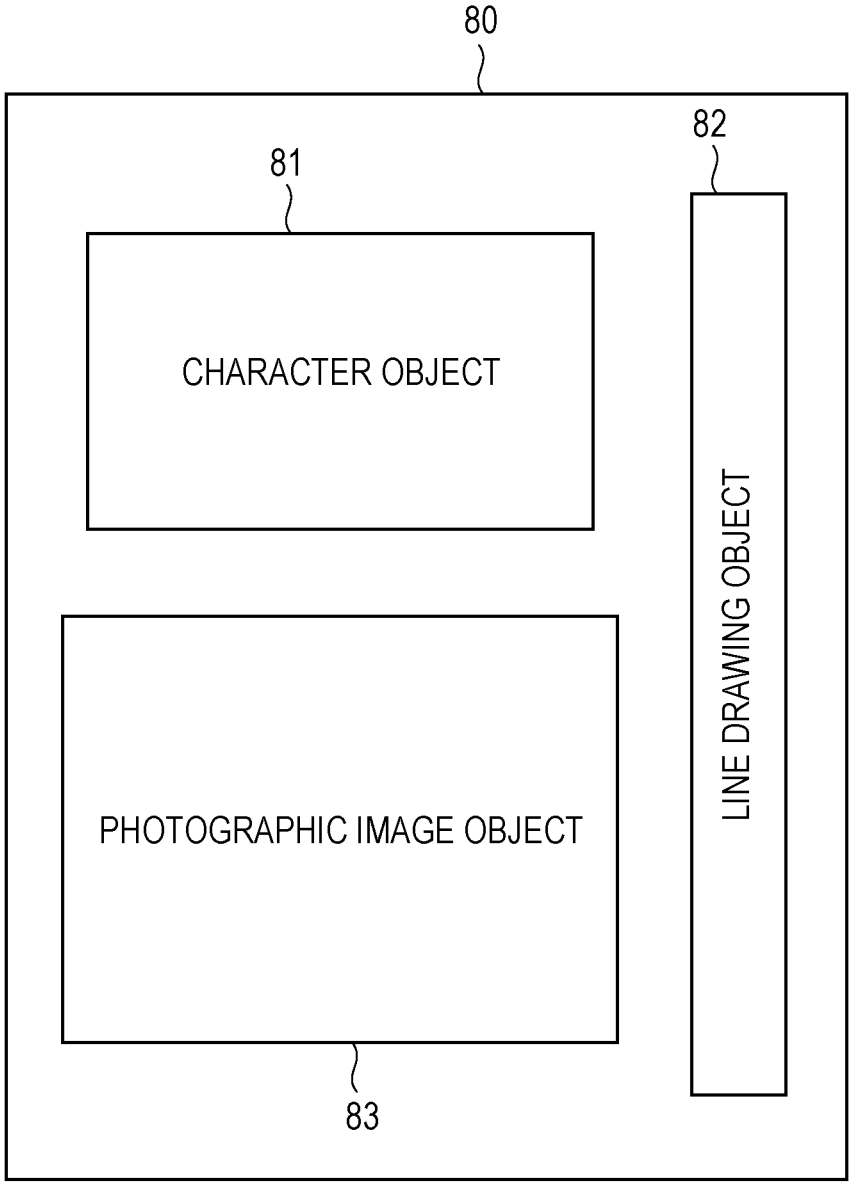
FIG. 12 is a schematic diagram illustrating a state in which the image data is rendered.

FIG. 12 is a schematic diagram illustrating a state in which the image data of FIG. 11 is rendered into bitmap data. It is noted that reference symbol 80 in FIG. 12 denotes an area for one sheet.

A character object 81 represents a state in which the text data 91 (FIG. 11) is rendered. Also, a line drawing object 82 represents a state in which the graphics data 92 (FIG. 11) is rendered. Also, a photographic image object 83 represents a state in which the raster image data 93 (FIG. 11) is rendered.

According to the present embodiment, when the image data is input, while the CPU 800 (FIG. 7) sequentially renders the respective commands of the image data into the bitmap data, the correction on the signal level is carried out for each object (the character object, the line drawing object, and the photographic image object).

Figure 13:
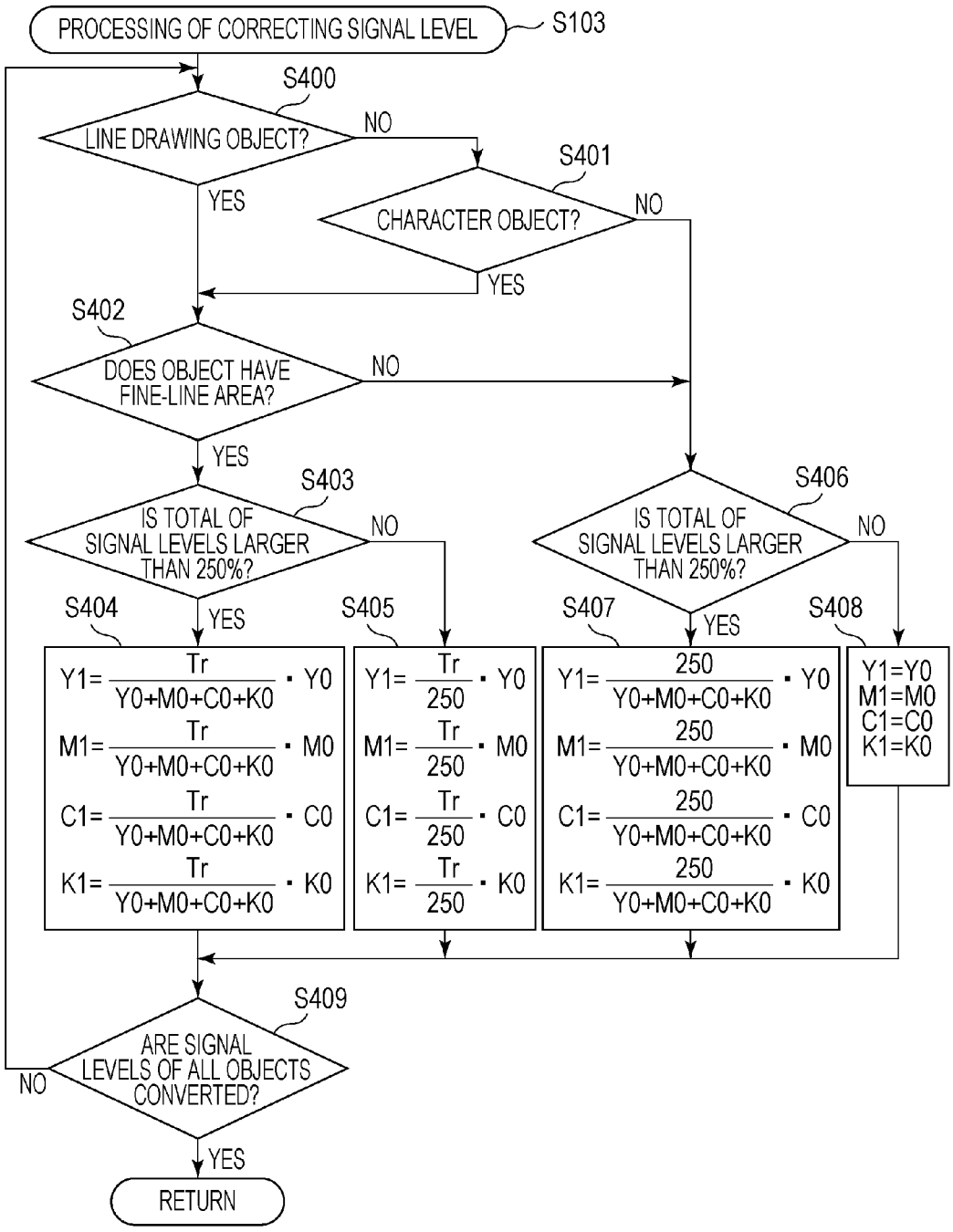
FIG. 13 is a flow chart representing a processing of correcting the signal level according to the first embodiment.

Hereinafter, the processing of correcting the signal level illustrated in step S103 of FIG. 8 will be described on the basis of a flow chart illustrated in FIG. 13. It is noted that the processing in this flow chart is executed while the CPU 800 reads out the program stored in the ROM 910.

First, the CPU 800 reads the image data and determines whether or not the result of the rendering of the image data is the line drawing object (S400). Herein, in a case where the command being rendered of the read image data is the graphics data, the CPU 800 determines that the result of the rendering of this result is the line drawing object.

In step S400, in a case where the result of the rendering of the image data is the line drawing object, the CPU 800 shifts to step S402 which will be described below.

On the other hand, in step S400, in a case where the result of the rendering of the image data is not the line drawing object, the CPU 800 determines whether or not the result of the rendering of the image data is the character object (S401). Herein, in a case where the command being rendered is the text data, the CPU 800 determines that the result of the rendering of this result is the character object.

In step S401, in a case where the result of the rendering of the image data is not the character object, the CPU 800 determines that the result of the rendering of the image data is the photographic image object, and the flow shifts to step S406 which will be described below.

On the other hand, in step S401, in a case where the result of the rendering of the image data is the character object, the CPU 800 determines whether or not this character object has the fine-line area (S402). At this time, the CPU 800 determines whether or not the character size specified by the command of the image data is smaller than or equal to the predetermined character size. It is noted that according to the present embodiment, the predetermined character size is 32 [point]. Herein, the CPU 800 functions as a character distinction unit that distinguishes a character having a size smaller than or equal to the predetermined character size from the input image data.

Also, in step S400 described above, in a case where the result of the rendering of the image data is the line drawing object, the CPU 800 determines whether or not this line drawing object has the fine-line area (S402). At this time, the CPU 800 determines whether or not the line thickness specified by the command of the image data is smaller than or equal to a predetermined line thickness. It is noted that according to the present embodiment, the predetermined line thickness is 1 [mm]. Herein, the CPU 800 functions as a line drawing distinction unit that distinguishes a line drawing having a thickness smaller than or equal to the predetermined thickness from the input image data.

In step S402, in a case where the rendered character object or the rendered line drawing object has the fine-line area, the CPU 800 determines whether or not the total of the signal levels is larger than 250 (S403).

In step S403, in a case where the image data is the text data, from the specified color of the character and the signal level (density) thereof, the CPU 800 determines whether or not the total of the signal levels of the respective color components is larger than 250. Also, in step S403, in a case where the image data is the graphics data, from the specified color of the line and the signal level (density) thereof, the CPU 800 determines whether or not the total of the signal levels of the respective color components is larger than 250.

In step S403, in a case where the total of the signal levels is larger than 250, the CPU 800 corrects the signal levels of the respective color components from Expression 1 to Expression 4 described above (S404), and the flow shifts to step S409 which will be described below. In step S404, the upper limit value Tr in Expression 1 to Expression 4 described above uses the upper limit value Tr stored in the RAM 920 in the processing of identifying the upper limit value Tr (FIG. 9) described above. In step S404, the CPU 800 functions as a change unit that changes the signal level in accordance with the width of the formed toner image.

On the other hand, in step S403, in a case where the total of the signal levels is smaller than or equal to 250, from Expression 10 to Expression 13 which will be described below, the CPU 800 corrects the signal levels of the respective color components (S405), and the flow shifts to step S409 which will be described below. In step S405, the signal levels of the respective color components are corrected in a manner that the toner image in which the total of the signal levels of the respective color components is smaller than or equal to 250 are not formed at a higher density than the toner image in which the signal levels are corrected so as to have the total of the signal levels larger than 250. It is noted that in Expression 10 to Expression 13, the signal level for each color component is multiplied by a ratio of the upper limit value Tr identified in step S100 described above to the upper limit value of the signal level (according to the present embodiment, 250) in a case where the toner height of the fine-line toner image is the same as the toner height of the solid toner image.

$$Y1 = \frac{Tr}{250} * Y0, \text{ (where } Y0 + M0 + C0 + K0 < 250) \quad \text{(Expression 10)}$$

$$M1 = \frac{Tr}{250} * M0, \text{ (where } Y0 + M0 + C0 + K0 < 250) \quad \text{(Expression 11)}$$

$$C1 = \frac{Tr}{250} * C0, \text{ (where } Y0 + M0 + C0 + K0 < 250) \quad \text{(Expression 12)}$$

-continued $$K1 = \frac{Tr}{250} * K0, \text{ (where } Y0 + M0 + C0 + K0 < 250) \quad \text{(Expression 13)}$$

It is noted that for the upper limit value Tr in Expression 10 to Expression 13, the upper limit value Tr stored in the RAM 920 is used in the processing of identifying the upper limit value Tr (FIG. 9) described above.

In Expression 10 to Expression 13, Y0 denotes a signal level before the correction at a time when the toner image of yellow is formed, M0 denotes a signal level of magenta before the correction, C0 denotes a signal level of cyan before the correction, and K0 denotes a signal level of black before the correction.

Also, in Expression 10 to Expression 13, Y1 denotes a signal level after the correction when the toner image of yellow is formed, M1 denotes a signal level of magenta after the correction, C1 denotes a signal level of cyan after the correction, and K1 denotes a signal level of black after the correction.

In step S401, in a case where the result of the rendering of the image data is not the character object, the CPU 800 determines whether or not the total of the signal levels is larger than 250 (S406). At this time, from the signal levels (density) of the respective dots specified by the image data, the CPU 800 determines whether or not the total of the signal levels of the respective color components is larger than 250.

Also, in step S402, in a case where the rendered character object or the rendered line drawing object does not have the fine-line area, the CPU 800 determines whether or not the total of the signal levels is larger than 250 (S406).

In step S406, in a case where the image data is the text data, from the specified color of the character and the signal level (density) thereof, the CPU 800 determines whether or not the total of the signal levels of the respective color components is larger than 250. Also, in step S406, in a case where the image data is the graphics data, from the specified color of the line and the signal level (density) thereof, the CPU 800 determines whether or not the total of the signal levels of the respective color components is larger than 250.

In step S406, in a case where the total of the signal levels is larger than 250, the CPU 800 sets the upper limit value Tr in Expression 1 to Expression 4 described above as 250 and corrects the signal levels of the respective color components (S407), and the flow shifts to step S409 which will be described below.

On the other hand, in step S406, in a case where the total of the signal levels is smaller than or equal to 250, the CPU 800 does not perform the correction on the signal level (S408), and the flow shifts to step S409 which will be described below.

Subsequently, in step S400 to step S408 described above, when the signal level of the command being rendered is converted, the CPU 800 determines whether or not the signal levels of all the commands described in the image data are converted (S409).

In step S409, in a case where the signal levels of all the commands are converted, the CPU 800 ends the processing of correcting the signal level, and the flow shifts to step S104 of the image forming processing (FIG. 8) described above.

On the other hand, in step S409, in a case where the signal levels of all the commands are not converted, the CPU 800 shifts to step S400, and until the signal levels of all the commands are converted, the processing of correcting the signal level is continued.

According to this, according to the present embodiment, it is possible to form the character having a size smaller than or equal to the predetermined size and the line drawing having a thickness smaller than or equal to the predetermined thickness at the toner deposition amount at which the scattering of the toner is suppressed.

According to the present embodiment, the effect is attained that irrespective of the change in the environment or the degradation of the developer, it is possible to suppress the scattering of the toner for the parts of the character and the line drawing.

A second embodiment will be described.

The present embodiment is different from the above-described first embodiment in the following points. Other elements according to the present embodiment are the same as those corresponding to the above-described first embodiment, and therefore a description thereof will be omitted.

According to the first embodiment, the scattering of the toner that occurs by the change in the environment, the degradation of the developer, or the like is suppressed. For that reason, the solid patch images 601*y*, 601*m*, 601*c*, and 601*k* and the fine-line patch images 602*y*, 602*m*, 602*c*, and 602*k* are formed, and the upper limit value Tr is identified on the basis of the average toner height ratio Rave calculated from these toner heights.

According to the present embodiment, a configuration is adopted in which the upper limit value Tr of the signal level at a time when the toner images of the respective color components are overlapped is identified in accordance with the material quality of the sheet on which the toner image is transferred in addition to the average toner height ratio Rave.

In coated paper or the like having a surface smoothness higher than normal paper, when a pressure is applied in the fusing unit, the toner of the toner image borne on this coated paper is likely to scatter. This is because when a pressure is applied on the normal paper on which the toner image is borne in the fusing unit, since the toner enters into irregularities on the surface of this normal paper, a force for bearing the toner works. On the other hand, when a pressure is applied on the coated paper on which the toner is borne in the fusing unit, since irregularities into which the toner can enter do not exist much on the surface of the coated paper, the force for bearing the toner is smaller than the normal paper, and the toner that is not borne any longer scatters.

For that reason, according to the present embodiment, in a case where the toner image is fused onto the coated paper, to set the toner deposition amount in the fine-line area to be smaller than the case in which the toner image is fused onto the normal paper, the upper limit value of the signal level of the toner image is set as a smaller value than the case in which the toner image is fused onto the normal paper.

Table 2 represents data indicating a correspondence relationship between the average toner height ratio Rave used according to the present embodiment, the upper limit value Tr of the signal level on the normal paper for preventing the scattering of the toner, and the upper limit value Trc of the signal level for preventing the scattering of the toner on the coated paper.

TABLE 2

| Average toner height ratio Rave | Upper limit value Tr of the signal level in the fine-line area (normal paper) | upper limit value Trc of the signal level in the fine-line area (coated paper) |
|---|---|---|
| 1.0 | 250 | 250 |
| 1.2 | 240 | 230 |

TABLE 2-continued

| Average toner height ratio Rave | Upper limit value Tr of the signal level in the fine-line area (normal paper) | upper limit value Trc of the signal level in the fine-line area (coated paper) |
|---|---|---|
| 1.4 | 230 | 220 |
| 1.6 | 220 | 210 |
| 1.8 | 210 | 200 |
| 2 | 200 | 190 |

According to the present embodiment, a configuration is adopted in which when the user transmits the image data from an external apparatus such as a PC, by selecting whether the material quality of the sheet is the normal paper or the coated paper, the information on the material quality of the sheet is input to the CPU 800 of the image forming apparatus (FIG. 7) together with the image data. Also, the data represented in Table 2 is previously stored in the ROM 910 (FIG. 7). It is noted that the correspondence relationship between the average toner height ratio Rave and the upper limit value Trc of the signal level for the coated paper in the fine-line area may be decided on the basis of the data on the toner height at which the fine-line toner image formed on the coated paper causes the scattering which is previously measured.

Also, according to the present embodiment, After the average toner height ratio Rave is calculated, this value of the average toner height ratio Rave is stored in the RAM 920 (FIG. 7). For that reason, a configuration is adopted in which the upper limit value of the signal level in the fine-line area is identified after information on a type of the sheet is input.

In the processing of correcting the signal level according to the present embodiment, in a case where the type of the sheet selected by the user is the normal paper, the CPU 800 (FIG. 7) corrects the signal levels of the respective color components so as to be smaller than or equal to the upper limit value Tr of the signal level for the normal paper based on the average toner height ratio Rave. Also, in a case where the type of the sheet selected by the user is the coated paper, the CPU 800 (FIG. 7) corrects the signal levels of the respective color components so as to be smaller than or equal to the upper limit value Trc of the signal level for the coated paper based on the average toner height ratio Rave.

For the method of correcting the signal level by using the upper limit value Trc of the signal level for the coated paper, a configuration may be adopted in which the calculation is carried out by using expressions while the upper limit value Tr of the signal level in Expression 1 to Expression 4 described above and Expression 10 to Expression 13 is replaced by the upper limit value Trc of the signal level for the coated paper.

According to the present embodiment, even in a case where the sheet is the coated paper, the signal level at a time when the toner image fused on this coated paper is formed can be converted into the signal level at which the scattering of the toner is suppressed.

Also, according to the present embodiment, a configuration is adopted in which the upper limit value Tr of the signal level for the normal paper in the fine-line area and the upper limit value Trc of the signal level for the coated paper in the fine-line area are switched in accordance with whether the sheet selected by the user is the normal paper or the coated paper. However, a configuration may be adopted in which the data indicating the correspondence relationship between the average toner height ratio and the upper limit value of the signal level is stored in the ROM 910 for each material quality of the sheet. With this configuration, the upper limit value of the signal level is identified in accordance with the material quality of the sheet selected by the user.

According to the first embodiment and the second embodiment, a configuration is adopted in which the character having a size smaller than or equal to the predetermined size and the line drawing having a thickness smaller than or equal to the predetermined thickness are extracted from the image data described in the page-description language. However, the configuration of extracting the character having a size smaller than or equal to the predetermined size and the line drawing having a thickness smaller than or equal to the predetermined thickness may be a configuration of extracting the fine-line area of the toner image from the image data input to the image forming apparatus through a related-art segmentation processing. For example, a configuration may be adopted in which through a segmentation processing described in Japanese Patent Laid-Open No. 2007-67932, the fine-line area having 1 [mm] (25 pixels) or smaller in a main scanning direction or a sub-scanning direction is identified, and the signal level of the character or the line drawing having this fine-line area is converted.

According to the present embodiment, irrespective of the change in the environment, the degradation of the developer, the material quality of the sheet, it is possible to suppress the scattering of the toner for the parts of the character and the line drawing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-293012 filed Dec. 28, 2010, which is hereby incorporated by reference herein in its entirety.

What is claimed is:

1. An image forming apparatus comprising:

an image forming unit configured to form an image on an image bearing member;

a decision unit configured to decide a first image forming condition of the image forming unit for forming the image at a width that is wider than a predetermined width so that a thickness of the image, in a direction orthogonal to a surface of the image bearing member, becomes thinner than or equal to a predetermined thickness;

an output unit configured to output a signal in accordance with the thickness of the image;

a control unit configured to cause the image forming unit to form a measurement image having a width that is narrower than or equal to the predetermined width; and a setting unit configured to set a second image forming condition of the image forming unit for forming the image at a width that is narrower than or equal to the predetermined width, based on a signal output by the output unit in accordance with the measurement image, so that the thickness of the image that is narrower than or equal to the predetermined width becomes thinner than or equal to the predetermined thickness.

2. The image forming apparatus according to claim 1, wherein the control unit is configured to cause the image forming unit to form the measurement image based on the first image forming condition.

3. The image forming apparatus according to claim 1, wherein the measurement image is a first measurement image and the control unit is configured to cause the image forming unit to form a second measurement image having a width that is wider than a predetermined width, and wherein the decision unit is configured to decide the first image forming condition based on a second signal output by the output unit in accordance with the formed second measurement image.

4. The image forming apparatus according to claim 1, wherein the output unit includes an irradiation section that irradiates the image with irradiation light and a light reception section that receives reflected light that is irradiated from the irradiation section and reflected by the image, and outputs a signal in accordance with a position of the reflected light on the light reception section.

5. The image forming apparatus according to claim 1, wherein the setting unit is configured to set the second image forming condition based on the signal output by the output unit and a material quality of a sheet for transferring the image that is formed on the image bearing member.

6. The image forming apparatus according to claim 1, further comprising:

a character distinction unit configured to distinguish a character having a character size that is smaller than a predetermined character size from an input image data, wherein the setting unit is configured to set the second image forming condition, when the character having the character size is formed by the image forming unit.

7. The image forming apparatus according to claim 1, further comprising:

a line drawing distinction unit configured to distinguish a line drawing having a thickness that is thinner than a predetermined thickness from an input image data, wherein the setting unit is configured to set the second image forming condition, when the line drawing having the thickness is formed by the image forming unit.

8. An image forming apparatus comprising:

a correction unit configured to correct image data;

an image forming unit configured to be controlled based on an image forming condition and configured to form an image on an image bearing member based on the image data corrected by the correction unit;

a measurement unit configured to measure a height of a measurement image formed on the image bearing member by the image forming unit; and a control unit configured to control the image forming unit to form a first measurement image, obtain first height information corresponding to the height of the first measurement image measured by the measurement unit, decide the image forming condition based on the obtained first height information, control the image forming unit based on the decided image forming condition, control the image forming unit to form a second measurement image, the second measurement image having a width that is narrower than that of the first measurement image, obtain second height information corresponding to the height of the second measurement image measured by the measurement unit, and set a limit value based on the obtained second height information, wherein the correction unit is configured to correct image data corresponding to a fine-line image formed by the image forming apparatus so that a toner amount of the fine-line image is smaller than the limit value.

9. The image forming apparatus according to claim 8, wherein the fine-line image has a width that is narrower than a predetermined width.

10. The image forming apparatus according to claim 8, wherein the toner amount is an amount of toner adhering to one pixel.

11. The image forming apparatus according to claim 8, wherein the width of the second measurement image is a width of the second measurement image in a shorter-side direction.

12. The image forming apparatus according to claim 8, wherein the height of the measurement image is a height of the measurement image in a direction orthogonal to a surface of the image bearing member.

13. The image forming apparatus according to claim 8,
wherein the image data includes object data indicating an object of an image corresponding to the image data, and
wherein, in a case where the object data includes a character object data corresponding to a character image, the correction unit corrects image data corresponding to the character image so that a toner amount of the character image is smaller than the limit value.

14. The image forming apparatus according to claim 8,
wherein the image data includes object data indicating an object of an image corresponding to the image data, and
wherein, in a case where the object data includes a line drawing object data corresponding to a line drawing image, the correction unit corrects image data corresponding to the line drawing image so that a toner amount of the line drawing image is smaller than the limit value.

15. The image forming apparatus according to claim 8,
wherein the measurement unit includes an irradiation section that irradiates light to the image bearing member and a light receiving section that receives light that is reflected by the measurement image on the image bearing member, and
wherein the height information corresponds to a light receiving result of the light receiving section.

16. The image forming apparatus according to claim 15,
wherein the light receiving section is a line sensor including a plurality of light receiving elements, and
wherein the height information includes information indicating a first light receiving element which receives light with highest intensity reflected by the image bearing member and information indicating a second light receiving element which receives light with highest intensity reflected by the measurement image.

17. The image forming apparatus according to claim 15,
wherein the light receiving section is an area sensor, and
wherein the height information includes information indicating a barycentric position of the light reflected by the image bearing member in the area sensor and information indicating a barycentric position of the light reflected by the measurement image in the area sensor.

18. The image forming apparatus according to claim 8,
wherein the image bearing member conveys the image, and
wherein a longer-side direction of the second measurement image is not parallel to a direction in which the image bearing member conveys the image.

19. The image forming apparatus according to claim 8, further comprising an input unit configured to input a type of a recording medium,
wherein the image forming unit transfers the image formed on the image bearing member onto the recording medium, and
wherein the limit value is set according to a type of the recording medium input by the input unit.

20. The image forming apparatus according to claim 8, further comprising a prohibition unit configured to prohibit the image forming apparatus from forming the image in a case where the height of the second measurement image is higher than a predetermined height.

* * * * *